US012203180B2

(12) United States Patent
Fontecave et al.

(10) Patent No.: US 12,203,180 B2
(45) Date of Patent: Jan. 21, 2025

(54) SURFACE-MODIFIED ELECTRODES AND THEIR USE IN $CO_2$ AND CO REDUCTION

(71) Applicants: PARIS SCIENCES ET LETTRES, Paris (FR); COLLEGE DE FRANCE, Paris (FR); CENTRE NATIONAL DE LA RECHERCHE SCIENTIFIQUE, Paris (FR)

(72) Inventors: Marc Fontecave, Saint-Ismier (FR); Victor Mougel, Zurich (CH); David Wakerley, Paris (FR); Sarah Lamaison, Saint-Jean-de-Luz (FR)

(73) Assignees: PARIS SCIENCES ET LETTRES, Paris (FR); COLLEGE DE FRANCE, Paris (FR); CENTRE NATIONAL DE LA RECHERECHE SCIENTIFIQUE, Paris (FR)

( * ) Notice: Subject to any disclaimer, the term of this patent is extended or adjusted under 35 U.S.C. 154(b) by 61 days.

(21) Appl. No.: 17/422,328

(22) PCT Filed: Jan. 29, 2020

(86) PCT No.: PCT/EP2020/052193
§ 371 (c)(1),
(2) Date: Jul. 12, 2021

(87) PCT Pub. No.: WO2020/157151
PCT Pub. Date: Aug. 6, 2020

(65) Prior Publication Data

US 2022/0106692 A1 Apr. 7, 2022

(30) Foreign Application Priority Data

Jan. 29, 2019 (EP) ..... 19305109

(51) Int. Cl.
*C25B 11/031* (2021.01)
*C25B 3/03* (2021.01)
(Continued)

(52) U.S. Cl.
CPC ..... *C25B 11/031* (2021.01); *C25B 3/03* (2021.01); *C25B 3/07* (2021.01); *C25B 3/26* (2021.01); *C25B 11/042* (2021.01)

(58) Field of Classification Search
None
See application file for complete search history.

(56) References Cited

U.S. PATENT DOCUMENTS

2011/0143119 A1* 6/2011 Bell ..... B22F 1/17 428/221
2013/0048506 A1 2/2013 Chen
(Continued)

FOREIGN PATENT DOCUMENTS

CN 103 849 910 6/2014

OTHER PUBLICATIONS

Y. Hu et al. / Thin Solid Films 519 (2010) 1314-1318 (Year: 2010).*
(Continued)

*Primary Examiner* — Wojciech Haske
(74) *Attorney, Agent, or Firm* — NIXON & VANDERHYE

(57) ABSTRACT

Disclosed are surface modified electrodes, their process of preparation and their use in the electrolytic reduction of carbon dioxide and/or carbon monoxide, as well as an electrochemical cell including the electrode.

17 Claims, 21 Drawing Sheets

(51) Int. Cl.

| | |
|---|---|
| ***C25B 3/07*** | (2021.01) |
| ***C25B 3/26*** | (2021.01) |
| ***C25B 11/042*** | (2021.01) |

(56) References Cited

U.S. PATENT DOCUMENTS

| | | | |
|---|---|---|---|
| 2014/0110268 | A1 | 4/2014 | Jackson et al. |
| 2016/0193595 | A1 | 7/2016 | Nagpal et al. |
| 2017/0073825 | A1 | 3/2017 | Sugano et al. |
| 2018/0102550 | A1 | 4/2018 | Coridan et al. |

OTHER PUBLICATIONS

International Search Report for PCT/EP2020/052193 mailed Mar. 13, 2020, 4 pages.

Written Opinion of the ISA for PCT/EP2020/052193 mailed Mar. 13, 2020, 9 pages.

Vayenas et al., "Modern Aspects of Electrochemistry," No. 42, Springer, New York, 2008, 434 pages.

Mistry et al., "Highly selective plasma-activated copper catalysts for carbon dioxide reduction to ethylene," Nature Communications, 2016, vol. 7, 9 pages.

Jović et al., "Morphology of Electrochemically and Chemically Deposited Metals," Springer International Publishing, 2016, 379 pages.

Dinh et.al., "CO2 electroreduction to ethylene via hydroxide-mediated copper catalysis at an abrupt interface," Science, May 18, 2018, pp. 783-787.

Yoon et al., "Hierarchical micro/nano structures for super-hydrophobic surfaces and super-lyophobic surface against liquid metal," Micro and Nano Systems Letters, 2014, vol. 2, 18 pages.

Xie et al., "Amino Acid Modified Copper Electrodes for the Enhanced Selective Electroreduction of Carbon Dioxide towards Hydrocarbons," Energy & Environmental Science, 2015, 10 pages.

Kim et al., "Copper nanoparticle ensembles for selective electroreduction of CO2 to C2-C3 products," Proc. Natl. Acad. Sci., Oct. 3, 2017, vol. 114, No. 40, pp. 10560-10565.

De Luna et al., "Catalyst electro-redeposition controls morphology and oxidation state for selective carbon dioxide reduction," Nature Catalysis, Feb. 2018, 9 pages.

* cited by examiner (a) Before catalysis (b) Before catalysis

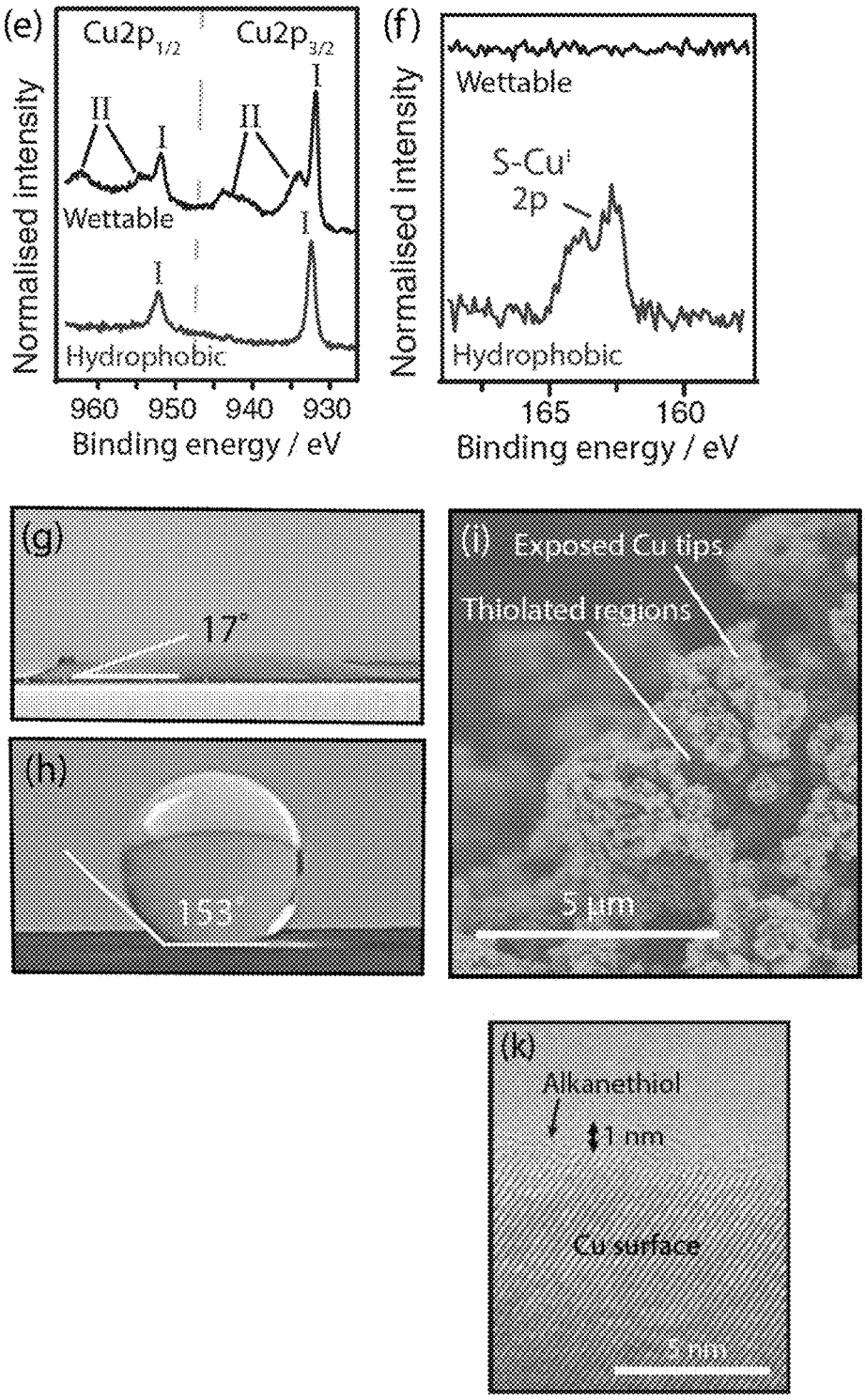
Figures 4e, 4f, 4g, 4h, 4i, and 4k

Figures 16a, 16b, 16, and 16d.

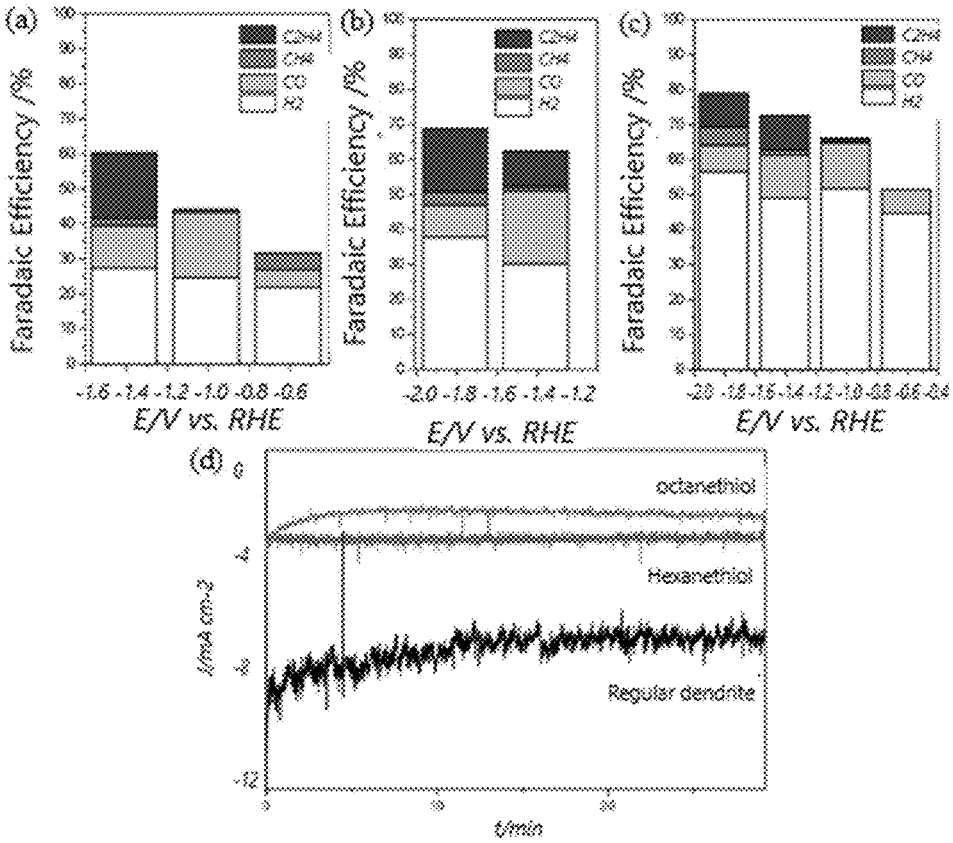
Figures 19a, 19b, 19, and 19d

SURFACE-MODIFIED ELECTRODES AND THEIR USE IN $CO_2$ AND CO REDUCTION

This application is the U.S. national phase of International Application No. PCT/EP2020/052193 filed Jan. 29, 2020 which designated the U.S. and claims priority to EP patent application Ser. No. 19/305,109.1 filed Jan. 29, 2019, the entire contents of each of which are hereby incorporated by reference.

BACKGROUND OF THE INVENTION

Field of the Invention

The present invention concerns surface-modified electrodes, their process of preparation and their use in the electrolytic reduction of carbon dioxide and/or carbon monoxide, as well as an electrochemical cell comprising said electrodes.

The reduction of carbon dioxide, $CO_2$, is a potential industrial route to valorize $CO_2$ into high-value feedstocks. This process has the dual benefit of reducing atmospheric $CO_2$ levels and providing a hydrocarbon fuel from non-fossil sources.

DESCRIPTION OF THE RELATED ART

There are many existing examples of $CO_2$ reduction on metal cathodes. Copper is the most commonly used metal for this reaction as it is the only surface capable of forming large quantities of hydrocarbon products. Pioneering work on this subject was carried out by Hori et al. (Hori, Y. In Modern Aspects of Electrochemistry; Vayenas, C. G., White, R. E., Gamboa-Aldreco, M. E., Eds.; Springer New York: New York, NY, 2008, p 89), who showed that electrodes consisting of Copper metal could generate ethylene and ethanol with Faradaic efficiencies (FEs) of 25.5% and 5.7% respectively at pH 7. Despite this interesting activity, current density was limited to 5 mA $cm^{-2}$ at a relatively high overpotential (−1 V vs. reversible hydrogen electrode, RHE), due to the low surface area of the material. Furthermore, this electrode showed a relatively high FE for $H_2$ evolution of 20%. Although interesting, such low currents (without high selectivity) have limited interest for large-scale application of such electrodes.

To improve activity and selectivity over proton reduction, and to encourage the production of hydrocarbons, contemporary research has sought to optimize the surface area, electrode composition and electrolyte solution used for Cu-driven $CO_2$ reduction. In general, this work has focused on the use of 'oxide-derived Cu'. Such materials originally consist of Cu oxides (such as $Cu_2O$ and CuO). Upon application of negative potentials in water, these oxides are reduced to metallic Cu, which is the active catalyst. The reduction of the oxide has been shown to form nanostructured electrode surfaces consisting of many grain boundaries (H. Mistry, A. S. Varela, C. S. Bonifacio, I. Zegkinoglou, I. Sinev, Y.-W. Choi, K. Kisslinger, E. A. Stach, J. C. Yang, P. Strasser & B. Roldan Cuenya, Highly selective plasma-activated copper catalysts for carbon dioxide reduction to ethylene, Nat. Commun. 2016, 7, 12123). Despite promising activity, these purely metallic electrodes often still produce significant amounts of $H_2$.

US patent application number 2017/0073825 A1 describes catalysts for the reduction of $CO_2$ to CO. Among the different catalysts disclosed are dendritic gold electrodes. These dendritic structures are prepared with the aid of thiol compounds, such as cysteine. Cysteine helps to control the formation of the dendrites but is ultimately removed from the surface during the production process, resulting in a metallic electrode devoid of thiol.

Cu/C composite materials generally show higher selectivity for the $CO_2$ reduction reaction to C2 products, such as ethylene and ethanol, and less proton reduction to hydrogen. The publication by Sargent et al. (Cao-Thang Dinh, Thomas Burdyny, Md Golam Kibria, Ali Seifitokaldani, Christine M. Gabardo, F. Pelayo Garcia de Arquer, Amirreza Kiani, Jonathan P. Edwards, Phil De Luna, Oleksandr S. Bushuyev, Chengqin Zou, Rafael Quintero-Bermudez, Yuanjie Pang, David Sinton, Edward H. Sargent, $CO_2$ electroreduction to ethylene via hydroxide-mediated copper catalysis at an abrupt interface, Science, 2018, 360, 783-787) describes a layered surface comprised of polytetrafluorethylene/Cu nanoparticle/carbon nanoparticle/graphite electrode. The gas-diffusion layer electrode maintained a high concentration of $CO_2$ next to the Cu catalyst surface, so that proton reduction was greatly reduced. The electrode could generate ethylene with a FE of up to 70%, ethanol up to 10% and $H_2$ as low as 5%. This activity was reported at low overpotentials (−0.54 V vs. RHE), yet with large catalytic currents (−275 mA $cm^{-2}$). Despite promising activity, the above example only achieves such large current densities in highly basic electrolyte, which are difficult to sustain in a flow of $CO_2$ due to acidifying effects of $CO_2$ dissolution, which buffers in bicarbonate solutions around pH 7.

One aim of the present invention is to provide new hydrophobic electrodes that can be used in the selective electrochemical reduction of $CO_2$ and/or CO into hydrocarbon(s) and/or alcohol(s), or the selective reduction of $CO_2$ into CO, without concomitant proton reduction to hydrogen.

Another aim of the present invention is to provide a procedure for preparation of said electrodes.

Still another aim of the present invention is to provide a process for said selective electrochemical reduction.

The present invention further aims to provide an electrochemical cell comprising said electrode for use in the selective reduction of CO and/or $CO_2$.

SUMMARY OF THE INVENTION

The present invention relates to an electrode comprising or consisting of:

a metallic nanostructure, the metal of which is selected from the group of Cu, Zn, Ni, Fe, and Ag or mixtures thereof, said metallic nanostructure being part of a metallic hierarchical structure containing both micro and nanostructuration, in particular containing dendritic hierarchical structures, said metallic hierarchical structure being of the same metal as defined above, a hydrophobic layer of compounds partially or totally covering the surface of said metallic hierarchical structure, said compounds being chemisorbed to said surface, said metallic hierarchical structure being porous, said compounds being chosen from the group of:

a compound of Formula 1,

R—A Formula 1 wherein,

A represents,

—SH,

—$P(O)(OH)_2$,

—$CO_2H$,

—SeH,

—TeH,

—$Si(OH)_3$, $SiX_3$, wherein X represents a halogen, preferably fluorine, chlorine or bromine, an acetylacetone group having the structure of Formula 2, Formula 2

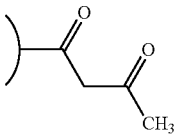

R is chosen from the groups of, (C2-C100)-alkyl linear or branched, (C2-C100)-alkenyl linear or branched, (C2-C100)-alkynyl linear or branched, (C2-C100)-heteroralkyl linear or branched, (C2-C100)-heteroalkenyl linear or branched, (C2-C100)-heteroalkynyl linear or branched, said alkyl, alkenyl, alkynyl, heteroalkyl, heteroalkenyl and heteroalkynyl can be further substituted by one or more groups selected from:

amines,

—$OR^a$, wherein $R^a$ represents a hydrogen atom or a (C1-C20)-alkyl group, preferably a (C1-C10)-alkyl group, more preferably a (C1-C5)-alkyl group, halogen, preferably fluorine, chlorine or bromine, aryl, preferably pyridyl or imidazoyl, —$CO_2R^b$, wherein $R^b$ represents a hydrogen atom or a (C1-C20)-alkyl group, preferably a (C1-C10)-alkyl group, more preferably a (C1-C5)-alkyl group, —$CX_3$ groups, wherein X represents a halogen, preferably fluorine, chlorine or bromine, a compound of Formula 3, Formula 3

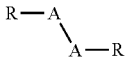

wherein,

A represents Se or S,

R is a group as defined above, polysiloxane compounds chosen from the groups of (C1-C100)-polyalkylsiloxane, or polyarylsiloxane, said polyalkylsiloxane and polyarylsiloxane can be further substituted by one or more groups selected from:

amines,

—$OR^a$, wherein $R^a$ represents a hydrogen atom or a (C1-C20)-alkyl group, preferably a (C1-C10)-alkyl group, more preferably a (C1-C5)-alkyl group, halogen, wherein X represents a halogen, preferably fluorine, chlorine or bromine, —$CO_2R^a$, wherein $R^a$ represents a hydrogen atom or a (C1-C20)-alkyl group, preferably a (C1-C10)-alkyl group, more preferably a (C1-C5)-alkyl group, said electrode having a hydrophobicity as determined by contact angle measurement from 130° to 175°, said electrode having an electrochemically active surface area (EASA) lower than 10% of the geometric surface area of said metallic hierarchical structure.

The present invention in particular concerns an electrode comprising or consisting of:

a metallic nanostructure, the metal of which is selected from the group of Cu, Zn, Ni, Fe, and Ag or mixtures thereof, said metallic nanostructure being part of a metallic hierarchical structure containing both micro and nanostructuration, in particular containing dendritic hierarchical structures, said metallic hierarchical structure being of the same metal as defined above, a hydrophobic layer of compounds partially or totally covering the surface of said metallic hierarchical structure, said compounds being chemisorbed to said surface, wherein of from 0 to 50% of the surface of said metallic hierarchical structure is devoid of hydrophobic layer, said metallic hierarchical structure being porous, said compounds being chosen from the group of:

a compound of Formula 1,

R—A Formula 1 wherein,

A represents,

—SH,

—$P(O)(OH)_2$,

—$CO_2H$,

—SeH,

—TeH,

—$Si(OH)_3$, $SiX_3$, wherein X represents a halogen, preferably fluorine, chlorine or bromine, an acetylacetone group having the structure of Formula 2, Formula 2

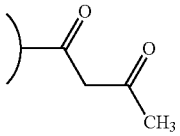

R is chosen from the groups of, (C2-C100)-alkyl linear or branched, (C2-C100)-alkenyl linear or branched, (C2-C100)-alkynyl linear or branched, (C2-C100)-heteroralkyl linear or branched, (C2-C100)-heteroalkenyl linear or branched, (C2-C100)-heteroalkynyl linear or branched, said alkyl, alkenyl, alkynyl, heteroalkyl, heteroalkenyl and heteroalkynyl can be further substituted by one or more groups selected from:

amines,

—$OR^a$, wherein $R^a$ represents a hydrogen atom or a (C1-C20)-alkyl group, preferably a (C1-C10)-alkyl group, more preferably a (C1-C5)-alkyl group, halogen, preferably fluorine, chlorine or bromine, aryl, preferably pyridyl or imidazoyl, —$CO_2R^b$, wherein $R^b$ represents a hydrogen atom or a (C1-C20)-alkyl group, preferably a (C1-C10)-alkyl group, more preferably a (C1-C5)-alkyl group, —$CX_3$ groups, wherein X represents a halogen, preferably fluorine, chlorine or bromine, a compound of Formula 3, Formula 3

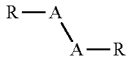

wherein,

A represents Se or S,

R is a group as defined above, polysiloxane compounds chosen from the groups of (C1-C100)-polyalkylsiloxane, or polyarylsiloxane, said polyalkylsiloxane and polyarylsiloxane can be further substituted by one or more groups selected from:

amines,

—$OR^a$, wherein $R^a$ represents a hydrogen atom or a (C1-C20)-alkyl group, preferably a (C1-C10)-alkyl group, more preferably a (C1-C5)-alkyl group, halogen, wherein X represents a halogen, preferably fluorine, chlorine or bromine, —$CO_2R^a$, wherein $R^a$ represents a hydrogen atom or a (C1-C20)-alkyl group, preferably a (C1-C10)-alkyl group, more preferably a (C1-C5)-alkyl group, said electrode having a hydrophobicity as determined by contact angle measurement from 130° to 175°, said electrode having an electrochemically active surface area (EASA) lower than 10% of the geometric surface area of said metallic hierarchical structure.

The term "metallic nanostructure" refers to the part of a metallic hierarchical structure containing nanoscale features such as nanoparticles, nanowires, nanosheets or nanodendrites.

The term "metallic hierarchical structure" refers to a multidimensional structure, or "architecture", comprising both micro- and nanostructuration, having features on two or more scales. The metallic hierarchical structures thus have a surface containing microscale features, such as micropores or microwires, the structure of said microscale features further comprising nanoscale features, referred to as the metallic nanostructure.

Hierarchically-structured surfaces are thus those made up of nano-scale structures that form part of a larger microscale structure; thereby generating a 'hierarchy' in the sense that the larger structure is made up of many smaller structures (Yoon, Y., Kim, D. & Lee, J B. Micro and Nano Syst. Lett., 2014, 2, 3).

The term "dendritic hierarchical structure" refers to a specific fractal metallic hierarchical structure the shape of which results from favored growth along energetically favorable crystallographic directions. The dendritic hierarchical structure can for instance have a tree-like form. Said dendritic hierarchical structure, comprises nanostructuration in the form of dendrites.

The metallic hierarchical structures according to the present invention are made of metal in the $M^{(0)}$ form. These metallic structures are thus substantially free of metal oxides, but traces of these can exist due to unwanted oxidation of the surface. The of the surface occupied by metal oxide is preferably below 10%, in particular below 5% and more in particular below 1%, with respect to the total surface area.

Mixtures of metals refer to alloys of metals.

The term "porous" means containing pores. The pores according to the present invention are repeating connecting voids in between the three-dimensional solid structure, such that gas is able to penetrate inside the nanostructured surface.

FIG. 17 illustrates the presence of pores being in the specific case of a dendritic copper hierarchical structure, as visualized by scanning electron microscopy (SEM).

It is also to be understood that the electrode of the invention is claimed in its initial configuration, which is "inactive", and in a further configuration which is "active" with respect to electrochemical reactions.

An electrode comprising a hydrophobic layer of compounds totally covering the surface of the metallic hierarchical structure refers to an electrode wherein the hydrophobic layer covers 100% of said surface. In other words, there is no part of the metallic structure, or 0%, which is devoid of hydrophobic layer. In this case, the metallic surface is not exposed to the external environment of the electrode, such as an electrolyte solution. Said electrode is thus "inactive" with respect to electrochemical reactions.

An electrode comprising a hydrophobic layer of compounds partially covering the surface of the metallic hierarchical structure refers to an electrode wherein the hydrophobic layer covers more than 0%, but less than 100% of said surface, in particular more than 50%, but less than 100%. Thus, from more than 0% to 50% of the surface is devoid of hydrophobic layer. In this case, parts of the metallic surface are exposed to the external environment of the electrode such as the electrolyte solution. An electrode that is partially covered is thus "active" with respect to electrochemical reactions.

"Hydrophobicity" is defined as the substantial absence of attractive forces between the surface and water. The hydrophobicity is measured using "contact angle measurement", a technique in which a drop of water is placed on a surface. The contact angle is measured by determining the angle between the surface and the water drop at the contact point as illustrated in FIG. 9. A surface is considered hydrophobic when the contact angle is higher than 90°. The electrodes according to the present invention have a contact angle from 130° to 175°, indicating their hydrophobic character.

A "hydrophobic layer" in the present invention refers to a layer formed of compounds that are chemisorbed on a metallic surface. The hydrophobic character of said layer refers to the part of the layer that is exposed to the external environment, such as an electrolyte. The hydrophobic layer can be constituted of hydrophilic compounds wherein a hydrophilic group is attached to the metal surface and a hydrophobic chain points away from said metallic surface.

A hydrophobic layer of compounds according to the present invention is preferably a monolayer of compounds but can also be a multilayer of compounds, preferably a bilayer.

The term "monolayer" refers to a closely packed single layer of molecules on a surface.

The hydrophobic multilayer of compounds according to the present invention refers to multiple layers of molecules, preferably 2 to 50 layers, more preferably 2 to 20 layers, even more preferably 2 to 10 layers, and even more preferably 2 to 5 layers. In a preferred embodiment, the multilayer comprises 2 layers of molecules in which case the layer is referred to as a bilayer.

In case of a bilayer, a second layer is attached to the first layer, which itself is chemisorbed to the metallic surface. Said second layer being attached to the first layer through electrostatic interactions such as ionic interactions. The compounds constituting the hydrophobic first layer can, for instance, comprise amine groups that can bind a second layer of compounds comprising carboxylic acid groups through salt formation. Alternatively, when a first layer is formed having hydrophobic chains pointing away from the metal surface, a second layer can form in which the compounds constituting said second layer are bound in the opposite direction of the compounds constituting the first layer.

In case of a multilayer two or more layers are successively attached to the previous layer, in the same way is described above for the particular case of a bilayer.

With "chemisorbed" is meant the result of chemisorption. Chemisorption refers to a chemical reaction between a surface and an adsorbate. The adsorbate generally comprises a functional group able to react with said surface. Functional groups known for their chemisorption to metal surfaces include thiol groups, phosphoric acid groups and siloxanes.

It is understood that compounds involved in the present invention can be present in their deprotonated form when they are chemisorbed to the metallic surface. For instance, in case where said compound is an alkanethiol, the compound is chemisorbed to the metallic surface as an alkanethiolate.

The term "(C2-C100)-alkyl" refers to an alkyl group comprising from 2 to 100 carbon atoms, such as decyl, dodecyl or octadecyl. Compounds having a chain length inferior to 2 carbon atoms can be problematic. This is for instance the case of methanethiol, which is comprised of a single carbon atom and which is a gaseous substance the use of which poses problems.

With "C2-C100" is also meant the following values: C2-C80, C2-C60, C2-C40, C2-C20, C2-C10, C5-C100, C10-C100, C20-C100, C40-C100, C60-C100, C80-C100, C5-C90, C10-C80, C20-C60, C30-C40.

The term "(C2-C100)-alkenyl" refers to an alkenyl group comprising from 2 to 100 carbon atoms, that contains one or more double bonds, such as for example decenyl, dodecenyl or octadecenyl.

With "C2-C100" is also meant the following values: C2-C80, C2-C60, C2-C40, C2-C20, C2-C10, C5-C100, C10-C100, C20-C100, C40-C100, C60-C100, C80-C100, C5-C90, C10-C80, C20-C60, C30-C40.

The term "(C2-C100)-alkynyl" refers to an alkynyl group comprising from 2 to 100 carbon atoms, that contains one or more triple bonds, such as for example decynyl, dodecynyl or octadecynyl.

With "C2-C100" is also meant the following values: C2-C80, C2-C60, C2-C40, C2-C20, C2-C10, C5-C100, C10-C100, C20-C100, C40-C100, C60-C100, C80-C100, C5-C90, C10-C80, C20-C60, C30-C40.

The terms "(C2-C100)-heteroralkyl", "(C2-C100)-heteroalkenyl" and "(C2-C100)-heteroalkynyl" refer to compounds in which the alkyl, alkenyl and heteroalkynyl respectively further comprise one or more heteroatoms in the carbon chain. The heteroatom is preferably oxygen or nitrogen.

With "C2-C100" is also meant the following values: C2-C80, C2-C60, C2-C40, C2-C20, C2-C10, C5-C100, C10-C100, C20-C100, C40-C100, C60-C100, C80-C100, C5-C90, C10-C80, C20-C60, C30-C40.

With "polysiloxane" is meant a polymer having the general structure of formula II.

formula II

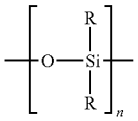

The polysiloxanes in the present invention have a degree of polymerization higher than 2 (n>2). A "(C1-C100)-polyalkylsiloxane" refers to a polymer wherein R is an alkyl group, such as methyl (polydimethylsiloxane) or ethyl (polydiethylsiloxane). A "polyarylsiloxane" is a polymer wherein R is an aryl group, such as phenyl (polydiphenylsiloxane). The polysiloxane polymers can be linear, or branched in the case where cross-linking was performed using conventional cross-linking agents such as methyltrimethoxysiloxane. Polysiloxanes are generally prepared by conventional polymerization reactions of suitable monomers, i.e silanols or dichlorosilanes. For instance, polydimethylsiloxane can be prepared by polycondensation of the monomer dichlorodimethylsilane in the presence of water, according to the scheme below:

$$n\mathrm{Si(CH_3)_2Cl_2}+(n+1)\mathrm{H_2O}\rightarrow \mathrm{HO[—Si(Ch_3)_2O—]}_n\mathrm{H}+2n\mathrm{HCl}$$

With "C1-C100" is also meant the following values: C1-C80, C1-C60, C1-C40, C1-C20, C1-C10, C5-C100, C10-C100, C20-C100, C40-C100, C60-C100, C80-C100, C5-C90, C10-C80, C20-C60, C30-C40.

With "aryl" is meant both aromatic compounds comprising only carbon atoms in the aromatic ring, and heteroaryl compounds, wherein the aromatic ring comprises one or more heteroatoms such as sulfur, nitrogen or oxygen.

The presence of the hydrophobic layer of compounds on the surface of the metallic hierarchical structure according to the present invention, results in an increase of the hydrophobicity of said metallic surface.

A non-coated metallic hierarchical structure is referred to as a "wettable metallic hierarchical structure", whereas a metallic hierarchical structure having a hydrophobic layer of compounds is referred to as a "hydrophobic metallic hierarchical structure".

The "electrochemically active surface area" (EASA) refers to the difference between the capacitance of the metallic hierarchically structured surface relative to a flat 1 $cm^2$ metallic surface. The capacitance is determined by cyclic voltammetry and calculated according to the Equation 1:

$$\frac{ia-ic}{2}=Cv \qquad \text{Equation 1}$$

Where C is the capacitance (F), $i_a$ is the anodic current at −0.15 V vs. SHE (A), $i_c$ is the cathodic current (A) and v is the scan rate. The capacitance was found by plotting the left side of Equation 1 against scan rate.

The term "geometric surface area" refers to the total surface area of the metallic nanostructure as measured by BET surface-area analysis. The acronym "BET" stands for "Brunauer, Emmett and Teller" and refers to a technique in which the surface area is established through the absorption of an inert gas on the material surface.

An electrochemically active surface area (EASA) lower than 10% of the geometric surface area refers to an EASA from 0 to 10%, in particular from 0 to 5%, more in particular from 0 to 1%, including 0%.

The present invention in particular concerns an electrode that can be used for the selective electrochemical reduction of $CO_2$ and/or CO into hydrocarbon(s) and alcohol(s). With "selective" is meant that concomitant proton reduction to hydrogen, a common side reaction, is limited. With "selective" is further meant that specific hydrocarbon(s), such as ethylene or alcohol(s) such as ethanol, can be produced. By varying the "architecture" of the metallic hierarchical structure, the metal that it comprises, and the compounds used for the preparation of the hydrophobic layer the selectivity of $CO_2$ and/or CO electrochemical reductions can be further controlled. The electrochemical reductions of the present invention can be performed in electrolyte solutions that are compatible with the use of $CO_2$.

The invention also relates to the electrode as defined above, wherein said hydrophobic layer covers at least 80% of said surface of said metallic hierarchical structure, the electrochemically active surface area being from of 0 to 1% of the geometric surface area.

In this embodiment, the hydrophobic layer covers the majority of the surface of the metallic hierarchical structure, preferably covering at least 90%, more preferably at least 95%, even more preferably at least 99% and even more preferably covering 100% of the surface of the metallic hierarchical structure. This is typically the case in the initially prepared electrodes not having been used in an electrolysis reaction. The relatively low EASA value reflects the relatively poor activity of these electrodes with respect to electrochemical reductions as compared to the corresponding "wettable electrodes" that do not comprise a hydrophobic layer of compounds.

The inventors have found that application of a reducing potential on electrodes in which the metallic surface is totally covered with hydrophobic layer, in aqueous electrolyte, results in an increase of the electrochemical active surface area (EASA). This increase slows down in time, eventually stabilizing. Said increase of the EASA can be attributed to partial loss of chemisorbed compound, resulting in partial loss of hydrophobic layer.

The inventors found that when a hierarchically nanostructured dendritic Cu surface with a coating of hydrophobic alkanethiol was subjected to a reducing potential, the loss of alkanethiol was observed by scanning electron microscopy imaging (SEM) as shown in FIG. 3.

The invention also relates to an electrode as defined above, wherein said surface of the metallic hierarchical structure is partially devoid of said compound, and wherein the parts of the surface of the metallic hierarchical structure that are not covered by the compounds are regions of the structure that are part of the electrochemically active surface area, wherein from 0 to 50% of the surface of said metallic hierarchical structure is devoid of hydrophobic layer, preferably between 0 to 30%, more preferably between 0 to 20%, and even more preferably between 0 to 10%, 0% being excluded, the electrochemically active surface area being from 0 to 40% of the geometric surface area, preferably from 0 to 30%, more preferably from 0 to 20% and even more preferably from 0 to 10%, or from 0 to 5%, or from 0 to 1%, 0% being excluded.

In this embodiment, the electrochemically active surface area is even more preferably from 0.1 to 40%, even more preferably from 1 to 40%, or from 0.1 to 10%, or from 1 to 10%, or from 0.1 to 5%, or from 1 to 5%.

The metallic hierarchical structure is only partially covered by the hydrophobic layer of compounds. "regions of the structure that are part of the electrochemically active surface area" refer to regions that are devoid of hydrophobic layer. Said regions are parts of the electrode where metallic surface is exposed to the electrolyte solution and can thus be referred to as "electrochemically active regions".

The electrochemically active regions are preferably located at the extremities of the hierarchical surface, preferably in the outer 20% of the surface of the hierarchical structure where aqueous solution is most likely to interact with the electrode surface.

In the case where the metallic hierarchical structure is a dendritic structure, said regions are preferably located at the tips of the dendrites, as illustrated in FIGS. 4*j* and 16*c* for the specific case of a copper dendritic structure covered with an alkanethiol layer.

In this embodiment, the electrode is not totally devoid of compounds. The hydrophobic layer still covers at least 50% of the surface of the metallic hierarchical structure The electrodes that are partially devoid of hydrophobic layer are "active" towards the electrochemical reduction of $CO_2$ and/or CO.

In an advantageous embodiment the present invention relates to an electrode as defined above, wherein said metal is Cu.

The copper hierarchical structure comprising a hydrophobic layer according to the present invention can be used for the reduction of $CO_2$ and/or CO into hydrocarbon(s) and/or alcohol(s). These electrodes particularly allow for the formation of hydrocarbon(s) and alcohol(s) comprising 2 carbon atoms, referred to as $C_2$ products. Such $C_2$ products include ethane, ethylene, acetylene and ethanol. Proton reduction is limited compared to the corresponding "flat electrodes" not having a metallic hierarchical structure and to the corresponding "wettable metallic hierarchical structures" not comprising a hydrophobic layer.

In an advantageous embodiment the present invention relates to an electrode as defined above, wherein said metal is Zn.

In an advantageous embodiment the present invention relates to the electrode as defined above, wherein said metal is a mixture of Zn and Ag.

In this embodiment, the Zn hierarchical structure is alloyed with Ag. The metallic hierarchical structure comprises Ag in a weight percentage with respect to the total weight of the alloy of Zn and Ag from 1% to 25%, preferably from 1% to 10%, even more preferably from 1% to 5%. The addition of Ag to the zinc hierarchical structure results in a higher electrode surface area, as the Ag assists in the growth of the hierarchically structured Zn, giving higher catalytic activity.

In an advantageous embodiment the present invention relates to the electrode as defined above, wherein said metal is a mixture of Zn and Cu.

In an advantageous embodiment, the present invention relates to an electrode wherein said compound is chosen from a compound of Formula 1, wherein A represents —SH.

The thiol group is among the most common functional groups used to chemisorb molecules to a metallic surface. The thiol group shows particularly strong chemisorption on gold, silver and copper surfaces.

In an advantageous embodiment, the present invention relates to an electrode as defined above, wherein said compound is chosen from 1-octadecanethiol or 1-dodecanethiol.

In an advantageous embodiment, the present invention relates to an electrode as defined above, wherein said compound is chosen from a compound of Formula 1, wherein A represents —SH, more particularly from 1-octadecanethiol or 1-dodecanethiol.

In an advantageous embodiment, the present invention relates to an electrode as defined above, wherein the metal of the metallic hierarchical structure is Cu, and wherein the compound is 1-octadecanethiol.

In an advantageous embodiment, the present invention relates to an electrode as defined above, wherein the metal of the metallic hierarchical structure is Cu, and wherein the compound is 1-dodecanethiol.

In an advantageous embodiment, the present invention relates to an electrode as defined above, wherein the metal of the metallic hierarchical structure is Cu, and wherein the compound is 1-dodecanethiol, and wherein said metallic hierarchical structure is dendritic.

In an advantageous embodiment, the present invention relates to an electrode as defined above, wherein the metal of the metallic hierarchical structure is Cu, and wherein the compound is 1-octadecanethiol, and wherein said metallic hierarchical structure is dendritic.

In an advantageous embodiment, the present invention relates to an electrode as defined above, wherein the metal of the metallic hierarchical structure is Zn, and wherein the compound is 1-octadecanethiol.

In an advantageous embodiment, the present invention relates to an electrode as defined above, wherein the metal of the metallic hierarchical structure is Zn, and wherein the compound is 1-dodecanethiol.

In an advantageous embodiment, the present invention relates to an electrode as defined above, wherein the metal of the metallic nanostructure is Zn, and wherein the compound is 1-dodecanethiol, and wherein said metallic hierarchical structure is dendritic.

In an advantageous embodiment, the present invention relates to an electrode as defined above, wherein the metal of the metallic hierarchical structure is Zn, and wherein the compound is 1-octadecanethiol, and wherein said metallic hierarchical structure is dendritic.

In an advantageous embodiment, the present invention relates to an electrode as defined above, wherein the metal of the metallic hierarchical structure is a mixture of Zn and Ag, and wherein the compound is 1-octadecanethiol.

In an advantageous embodiment, the present invention relates to an electrode as defined above, wherein the metal of the metallic hierarchical structure is a mixture of Zn and Ag, and wherein the compound is 1-dodecanethiol.

In an advantageous embodiment, the present invention relates to an electrode as defined above, wherein the metal of the metallic hierarchical structure is a mixture of Zn and Ag, and wherein the compound is 1-dodecanethiol, and wherein said metallic hierarchical structure is dendritic.

In an advantageous embodiment, the present invention relates to an electrode as defined above, wherein the metal of the metallic hierarchical structure is a mixture of Zn and Ag, and wherein the compound is 1-octadecanethiol, and wherein said metallic hierarchical structure is dendritic.

In an advantageous embodiment, the present invention relates to an electrode as defined above wherein said metal is chosen from Cu, and wherein said compound is chosen from a compound of Formula 1, wherein A represents —SH, and wherein said metallic hierarchical structure is dendritic.

In an advantageous embodiment, the present invention relates to an electrode wherein the porous metallic hierarchical structure has a pore size of from 1 μm to 500 μm, preferably from 1 μm to 100 μm, even more preferably from 50 μm to 100 μm.

The pore size refers to the size of the pores resulting from the microstructuration of the metallic hierarchical structure as measured by scanning electron microscopy (SEM).

In an advantageous embodiment, the present invention relates to an electrode wherein the hydrophobic layer of compounds is a monolayer having a thickness of 1 to 15 nm.

In an advantageous embodiment, the present invention relates to an electrode wherein the hydrophobic layer of compounds is a bilayer having a thickness of 2 to 30 nm.

The layer thickness is measured by transmission electron microscopy (TEM). Said thickness is dependent on the specific hydrophobic compounds that cover the metallic nanostructure. In addition, the proportion of surface that is covered with the hydrophobic layer with respect to the portion of surface devoid of monolayer also influences the thickness. A metallic surface that is partially covered with compound has a hydrophobic layer of decreased thickness as compared to a hydrophobic layer that totally covers the metallic surface. The loss of compounds during electrolysis can thus be observed by transmission electron microscopy.

In an advantageous embodiment, the present invention relates to an electrode with gas bubbles trapped between the surface of its metallic nanostructure and the electrolyte solution, said bubbles having a size greater than 300 μm.

The size of the bubbles corresponds to the diameter of said bubbles. In case the bubbles are not round, but for instance oval shaped, the largest diameter is meant. The maximum size of the bubbles depends on the size of the electrode, as the bubbles can engulf the entire surface of the electrode. Thus, the maximum size of the bubbles corresponds to 100% of the geometrical surface of said electrode.

When a gas is bubbled through an electrolyte solution comprising an electrode wherein the surface of the metallic nanostructure is partially devoid of compound, the so called "plastron effect" occurs. A plastron is a hydrophobic cuticle present on aquatic arachnids, such as the diving bell spider. The plastron is composed of micron-sized hydrophobic hairs that keep a pocket of air between the spider and the water, enabling underwater breathing.

The electrodes thus locally trap gas in the form of bubbles between the surface of the metallic nanostructure and the electrolyte solution. The occurrence of said bubbles is facilitated by the partial presence of the hydrophobic layer in combination with the metallic hierarchical structure. Neither a "wettable metallic hierarchical structure" nor a non-hierarchical structured surface that is totally covered with compounds show the occurrence of said "plastron effect".

In an advantageous embodiment, the present invention relates to an electrode having a BET surface area of at least 90 $cm^2/cm^2$.

In an advantageous embodiment, the electrode of the present invention is structurally and chemically stable during electrolysis at currents in the range of −0.1 to −50 mA $cm^{-2}$ and at potentials in the range of −1.5 V to −4 V.

With structurally and chemically stable is meant that the metallic hierarchical structure as well as the hydrophobic layer stay intact. Said "stability" refers to the electrode wherein the partial loss after initial application of a reducing potential has stabilized.

The electrochemical reduction of $CO_2$ and/or CO into hydrocarbon(s) and/or alcohol(s) according to the present invention are performed within these current and potential ranges.

In an advantageous embodiment, the present invention relates to an electrode, wherein the electrode is a cathode.

The present invention also relates to the use of an electrode as previously described, for the reduction of $CO_2$ gas into hydrocarbon(s) or alcohol(s) or mixtures thereof in aqueous medium.

The electrodes of the present invention can locally trap $CO_2$ gas between the surface of the metallic hierarchical structure and the electrolyte solution through the "plastron effect", as described above. These gas bubbles result in an increase in concentration of gaseous $CO_2$ at the electrode-solution interface, and also a limited interaction of protons with said electrode surface. Thus, the selectivity of $CO_2$ reduction is increased and concomitant proton reduction into hydrogen is limited.

Thus, in an advantageous embodiment, the present invention relates to the use of an electrode as previously described, for the reduction of $CO_2$ gas into hydrocarbon(s) or alcohol(s) or mixtures thereof in aqueous medium, wherein an electrode with gas bubbles trapped between the surface of its metallic nanostructure and the electrolyte solution is temporarily formed.

With "aqueous medium" is meant an electrolyte solution compatible with the use of $CO_2$ and/or CO. Bicarbonate based electrolytes are preferred, examples of bicarbonate include $CsHCO_3$, $NaHCO_3$ or $KHCO_3$.

For example, and in a non-limiting way, a surface modification of hierarchically structured dendritic Cu comprising a hydrophobic monolayer of alkanethiol, for example, resulted in $CO_2$ reduction with 90% Faradaic efficiency of which $C_2$ product formation comprised 75%. In comparison, the corresponding "wettable dendrite" showed a Faradaic efficiency of 24% for said reduction. At the same time, proton reduction was decreased from 71% to 12% Faradaic efficiency as compared to the "wettable dendrite".

The term "Faradaic efficiency" is a generally used indicator describing the efficiency with which electrons are transferred in a system facilitating an electrochemical reaction. The Faradaic efficiency is calculated after analysis of the samples by GC according to equation 2.

$$\text{Faradaic efficiency (\%)} = \frac{n(\text{product}) \times n(\text{electrons})}{(Q_{t=0} - Q_{t=x})} \times 100 \qquad \text{Equation 2}$$

where n(product) is the product measured (mol), n(electrons) is the number of electrons to make said product from $CO_2/H_2O$, F is the Faraday constant (C $mol^{-1}$), $Q_{t=0}$ is the charge passed at the point of injection (C) and $Q_{t=x}$ is the charge passed at x seconds before injection, (x being the time required to fill the GC sample loop based on sample loop size and $CO_2$ flow rate, C).

The present invention also relates to the use of an electrode as previously described, for the reduction of CO gas into hydrocarbon(s) or alcohol(s) or mixtures thereof in aqueous medium.

Compared to $CO_2$, CO gas is poorly soluble in aqueous solution (27.6 mg/L at 25° C.). Using CO as a reactant in aqueous medium is therefore challenging. The formation of bubbles through the "plastron effect" in the current invention allows for a sustained presence of CO at the electrode solution interface, facilitating the electrochemical reduction of said CO.

The present invention also relates to the use of an electrode as previously described, for the reduction of a mixture of CO and $CO_2$ gas into hydrocarbon(s) or alcohol(s) or mixtures thereof in aqueous medium.

The present invention also relates to the use of an electrode as previously described, for the reduction of $CO_2$ gas into CO in aqueous medium.

The reduction of $CO_2$ gas into CO according to the present invention is preferably carried out using Zn-based electrodes, Ag-based electrodes or ZnAg alloys or ZnCu alloys in which Zn comprises more than 50 weight percent with respect to the total weight of said alloys.

For example, and in a non-limiting way, the inventors found that the use of a hierarchically nanostructured dendritic Zn electrode alloyed with Ag comprising a hydrophobic monolayer of alkanethiol, resulted in $CO_2$ reduction to CO with 63% Faradaic efficiency. In comparison, the corresponding "wettable dendrite" showed a Faradaic efficiency of 42% for said transformation. At the same time, proton reduction was decreased from 38% to 14% Faradaic efficiency as compared to the "wettable dendrite".

In a preferred embodiment, the present invention relates to the use of an electrode in the reduction of $CO_2$ and/or CO into hydrocarbon(s) and alcohol(s) or mixtures thereof, wherein the hydrocarbon is ethylene.

In a preferred embodiment, the present invention relates to the use of an electrode in the reduction of $CO_2$ and/or CO into hydrocarbon(s) and alcohol(s) or mixtures thereof, wherein the alcohol(s) are selected from ethanol or propanol or mixtures thereof.

In a preferred embodiment, the present invention relates to the use of an electrode in the reduction of $CO_2$ or CO gas or mixture thereof into hydrocarbon(s) or alcohol(s) or mixtures thereof in aqueous medium, said hydrocarbon(s) being in particular ethylene, said alcohol(s) being in particular ethanol or propanol or mixtures thereof.

In a preferred embodiment, the present invention relates to the use of an electrode in the reduction of $CO_2$, CO or mixtures thereof into hydrocarbon(s) and alcohol(s) or mixtures thereof, wherein concomitant proton reduction to hydrogen is limited to 20% Faradaic efficiency.

Concomitant proton reduction is preferably limited to 10% Faradaic efficiency, more preferably limited to 5% faradaic efficiency and even more preferably limited to 1% Faradaic efficiency.

The expressions "limited to" is synonym to "at most". Thus, with the expression "wherein concomitant proton reduction to hydrogen is limited to 20% Faradaic efficiency" is meant a concomitant proton reduction to hydrogen of at most 20% Faraday efficiency, or from 0 to 20% Faraday efficiency.

The present invention also relates to a process for the preparation of an electrode as previously described comprising:

a step of coating of the surface of a metallic hierarchical structure of an electrode with a monolayer (first layer) of compounds, and optionally, a step of coating with a second layer, forming a bilayer.

The first step of coating is performed by contacting the metallic hierarchical structure with the compounds. Said contacting can preferably be performed by submerging the metallic hierarchical structure in liquid compounds. Excess compound can be removed by rinsing with an organic solvent such as ethyl acetate or THF. The coating procedure can be performed at higher temperatures in order to liquify the compounds. Alternatively, in case of liquid compound, the drop-casting method can be used wherein the compounds are dropped onto the surface until saturation. Excess compound can be removed by rinsing with an organic solvent.

The optional step of coating with a second layer can for instance be performed by adding a carboxylic acid containing compound to an amine containing monolayer. The bilayer is formed through salt formation between the amine- and carboxylic acid functional groups.

The step of coating with a second layer can alternatively be performed using the "Langmuir-Blodgett" technique. A film of amphiphilic compound is made on a water surface. The electrode comprising a monolayer of hydrophobic compound is submerged through said film, whereby the hydrophobic chains of the amphiphilic compounds bind to the hydrophobic chains of the compounds comprising the already formed monolayer to form the bilayer.

The present invention also relates to a process for the preparation of an electrode as previously described comprising:

a step of coating of the surface of a metallic hierarchical structure of an electrode with a layer of compounds, said layer being a multilayer.

In this embodiment, the step of coating leads to the formation of multilayers during a single step of coating. Said coating step is preferably performed using compounds with carbon chain lengths higher than 20 carbons through the drop-casting method. Excess compound is not washed off the surface and thus remains part of the layer.

Alternatively, in case of polysiloxanes, polymerization is carried out by contacting the hierarchically structured surface with a monomer. The monomer polymerizes both on the metallic surface and the forming layer, thus forming multilayers. A step of washing with an organic solvent removes excess monomer.

In a preferred embodiment, the present invention relates to a process for the preparation of an electrode as previously described, wherein said step of coating is performed under vacuum.

In the case where air sensitive compounds are used, the step of coating can be performed in vacuum to prevent undesired side reactions. Thiol compounds for instance are known to readily oxidize into disulfide compounds.

The present invention also relates to a process for the preparation of an electrode as previously described comprising:

an initial step of preparation of an electrode having a metallic hierarchical structure containing both micro and nanostructuration.

The present invention also relates to a process for the preparation of an electrode according as previously described comprising:

- an initial step of preparation of an electrode having a metallic hierarchical structure containing both micro and nanostructuration, and
- a step of coating of the surface of said metallic hierarchical structure of said electrode with compounds to obtain a metallic hierarchical structure coated with a hydrophobic layer of compounds, and
- optionally, a step of washing said metallic hierarchical structure coated with a hydrophobic layer of compounds, to obtain a hydrophobic monolayer (first layer) of compounds.

The present invention also relates to a process for the preparation of an electrode according as previously described comprising:

- an initial step of preparation of an electrode having a metallic hierarchical structure containing both micro and nanostructuration, and
- a step of contacting the surface of said metallic hierarchical structure of said electrode with a monomer, and
- a step of polymerization of said monomer, both on the surface of said metallic hierarchical structure, creating a first layer and on said first created layer, thus forming a multilayer.

The present invention also relates to a process for the preparation of an electrode as previously defined comprising:

- an initial step of preparation of an electrode having a metallic hierarchical structure containing both micro and nanostructuration, and
- a step of contacting the surface of said metallic hierarchical structure of said electrode with a monomer, precursor of a polymer, and
- a step of polymerization of said monomer, both on the surface of said metallic hierarchical structure, creating a first layer, and on said first created layer, thus forming a multilayer of polymerized compounds, in particular polysiloxane compounds.

Thus, for example, a multilayer of the polymer polydimethylsiloxane can be prepared by polycondensation of the monomer dichlorodimethylsilane.

General methods for the preparation of the metallic hierarchical structures of the present invention can be found in the book of Jović et.al. (Morphology of Electrochemically and Chemically Deposited Metals, Springer International Publishing, 2016).

The metallic hierarchical dendritic structures can be prepared by electrodeposition. A conducting support, typically metallic or carbon based, is placed in an electrochemical cell together with a counter electrode, preferably Pt. A solution of the metal or the mixture of metals is added to the cell and a current is applied resulting in the deposition of said metal or mixture of metals onto the conducting surface. The applied current is typically within the range of $-0.5$ A $cm^2$ to $-4$ A $cm^2$.

Cu nanowires can be generated by immersing flat Cu into a bath containing sodium hydroxide and potassium persulfate for sustained periods of time as described by Wang et. al. (Amino acid modified copper electrodes for the enhanced selective electroreduction of carbon dioxide towards hydrocarbons, *Energy Environ. Sci.,* 2016, 9, p. 1687-1695)

Cu nanoclusters, nanoneedles and nanowhiskers can be prepared by electroreduction of a copper oxychloride ($Cu_2(OH)_3Cl$) at an applied potential of $-0.7$ V, $-1.0$ V and $-1.2$ V respectively as described by Sargent et.al. (Catalyst electro-redeposition controls morphology and oxidation state for selective carbon dioxide reduction, Nature Catalysis, 2018, 1, p. 103-110).

Nanoparticles of Cu can be prepared by reduction of Cu salts in the presence of stabilizing ligands such as tetradecylphosphonic acid, which can then be deposited onto an electrode surface as described by Yang et.al. (Copper nanoparticle ensembles for selective electroreduction of $CO_2$ to $C_2$-$C_3$ products, *Proc. Natl. Acad. Sci. U.S.A.,* 2017, 114 (40), p. 10560-10565).

The present invention also relates to a process for the preparation of an electrode as previously described comprising:

- an initial step of preparation of an electrode having a metallic hierarchical structure containing both micro and nanostructuration, and
- a step of coating of the surface of said metallic hierarchical structure of said electrode with a monolayer (first layer) of compounds, and
- optionally, a step of coating with a second layer, forming a bilayer.

The present invention also relates to a process for the preparation of an electrode as previously described comprising:

- an initial step of preparation of an electrode having a metallic hierarchical structure containing both micro and nanostructuration, and
- a step of coating of the surface of said metallic hierarchical structure of said electrode with a layer of compounds, said layer being a multilayer.

DETAILED DESCRIPTION OF THE PREFERRED EMBODIMENTS

The present invention also relates to a process for the preparation of an electrode as previously described comprising:

a) a step of coating of the surface of a metallic hierarchical structure of an electrode with a monolayer (first layer) of compounds, and b) optionally, a step of coating with a second layer of compounds, forming a bilayer, and c) optionally, repeating step b), forming a multilayer.

In a preferred embodiment, the present invention relates to a process for the preparation of an electrode as previously described, wherein the metal of the metallic hierarchical structure is Cu.

In a preferred embodiment, the present invention relates to a process for the preparation of an electrode as previously described, wherein the metal of the metallic hierarchical structure is Zn.

In a preferred embodiment, the present invention relates to a process for the preparation of an electrode as previously described, wherein the metal of the metallic hierarchical structure is a mixture of Zn and Ag.

In a preferred embodiment, the present invention relates to a process for the preparation of an electrode as previously described, wherein the compound is 1-octadecanethiol or 1-dodecanethiol.

In a preferred embodiment, the present invention relates to a process for the preparation of an electrode as previously described, wherein the metal of the metallic hierarchical structure is Cu, and wherein the compound is 1-octadecanethiol.

In a preferred embodiment, the present invention relates to a process for the preparation of an electrode as previously described, wherein the metal of the metallic hierarchical structure is Cu, and wherein the compound is 1-dodecanethiol.

In a preferred embodiment, the present invention relates to a process for the preparation of an electrode as previously described, wherein the metal of the metallic hierarchical structure is Cu, and wherein the compound is 1-dodecanethiol, and wherein said metallic hierarchical structure is dendritic.

In a preferred embodiment, the present invention relates to a process for the preparation of an electrode as previously described, wherein the metal of the metallic hierarchical structure is Cu, and wherein the compound is 1-octadecanethiol, and wherein said metallic hierarchical structure is dendritic.

In a preferred embodiment, the present invention relates to a process for the preparation of an electrode as previously described, wherein the metal of the metallic hierarchical structure is Zn, and wherein the compound is 1-octadecanethiol.

In a preferred embodiment, the present invention relates to a process for the preparation of an electrode as previously described, wherein the metal of the metallic hierarchical structure is Zn, and wherein the compound is 1-dodecanethiol.

In a preferred embodiment, the present invention relates to a process for the preparation of an electrode as previously described, wherein the metal of the metallic hierarchical structure is Zn, and wherein the compound is 1-dodecanethiol, and wherein said metallic hierarchical structure is dendritic.

In a preferred embodiment, the present invention relates to a process for the preparation of an electrode as previously described, wherein the metal of the metallic hierarchical structure is Zn, and wherein the compound is 1-octadecanethiol, and wherein said metallic nanostructure is dendritic.

In a preferred embodiment, the present invention relates to a process for the preparation of an electrode as previously described, wherein the metal of the metallic hierarchical structure is a mixture of Zn and Ag, and wherein the compound is 1-octadecanethiol.

In a preferred embodiment, the present invention relates to a process for the preparation of an electrode as previously described, wherein the metal of the metallic hierarchical structure is a mixture of Zn and Ag, and wherein the compound is 1-dodecanethiol.

In a preferred embodiment, the present invention relates to a process for the preparation of an electrode as previously described, wherein the metal of the metallic hierarchical structure is a mixture of Zn and Ag, and wherein the hydrophobic compound is 1-dodecanethiol, and wherein said metallic hierarchical structure is dendritic.

In a preferred embodiment, the present invention relates to a process for the preparation of an electrode as previously described, wherein the metal of the metallic hierarchical structure is a mixture of Zn and Ag, and wherein the compound is 1-octadecanethiol, and wherein said metallic nanostructure is dendritic.

The present invention also relates to a process for the reduction of $CO_2$, CO or mixtures thereof into hydrocarbon(s) or alcohol(s) or mixtures thereof by an electrolysis reaction comprising:

placing an electrode of the present invention, together with an anode, in an electrolyte solution;

provision of an external source of electricity to said electrode;

provision of CO and/or $CO_2$ gas to the electrolyte solution;

recovery of the hydrocarbon(s) or alcohol(s) or mixtures thereof formed during electrolysis.

The electrolyte solution used in the present invention are compatible with the use of $CO_2$ and/or CO. Bicarbonate based electrolytes are preferred, examples of bicarbonate include $CsHCO_3$, $NaHCO_3$ or $KHCO_3$.

The external source of electricity is preferably provided through the attachment of a photovoltaic cell.

The present invention also relates to a process for the reduction of $CO_2$ into CO by an electrolysis reaction comprising:

placing an electrode of the present invention, together with an anode, in an electrolyte solution;

provision of an external source of electricity to said electrode;

provision of $CO_2$ gas to the electrolyte solution;

recovery of CO formed during electrolysis.

In a preferred embodiment, the present invention relates a process for the reduction of $CO_2$, CO or mixtures as previously described, wherein said provision of CO and/or $CO_2$ gas is accompanied by the trapping of said CO and/or $CO_2$ gas between the electrode surface and the electrolyte, leading to the formation of bubbles.

In order for bubbles to be formed and in addition for them to be sustained, CO and/or $CO_2$ gas need to be at least provided at a rate at which said gas is consumed during electrolysis reaction.

In a preferred embodiment, the present invention relates to a process as previously described, wherein concomitant proton reduction to hydrogen is limited to 20% Faradaic efficiency.

The present invention also relates to an electrochemical cell for converting CO and/or $CO_2$ to hydrocarbon(s) or alcohol(s) or mixtures thereof, comprising a container of an aqueous electrolyte solution;

an electrode according as previously described, in contact with the electrolyte solution;

an anode in contact with the electrolyte solution;

means for providing CO and/or $CO_2$ to the electrolyte solution;

means for providing electricity.

The present invention also relates to an electrochemical cell for converting $CO_2$ to CO, comprising a container of an aqueous electrolyte solution;

an electrode according as previously described, in contact with the electrolyte solution;

an anode in contact with the electrolyte solution;

means for providing $CO_2$ to the electrolyte solution;

means for providing electricity.

The present invention also relates to an electrochemical cell for converting $CO_2$ to CO, comprising a container containing an aqueous electrolyte solution;

an electrode of the invention as previously described, in contact with the electrolyte solution;

gas bubbles trapped between said surface of the electrode and said electrolyte solution;

an anode in contact with the electrolyte solution;

means for providing $CO_2$ to the electrolyte solution;

means for providing electricity.

LIST OF FIGURES

FIGS. 1(*a*) and (*b*) represent the capacitance measurements of wettable dendrite, hydrophobic dendrite and a flat Cu electrode, measured from the cyclic voltammetry performed at −0.15 V vs. the standard hydrogen electrode.

FIG. 2(*b*) represents the change in the LSV of hydrophobic Cu dendrite electrode after various times periods of electrolysis in 0.1 M $CsHCO_3$ at a current of −15 mA $cm^{-2}$.

FIGS. 4(*b*) and (*c*) are TEM images of an alkanethiol-treated Cu dendrite showing the layer of alkanethiol attached to the Cu surface.

Figures 6A, 6B:
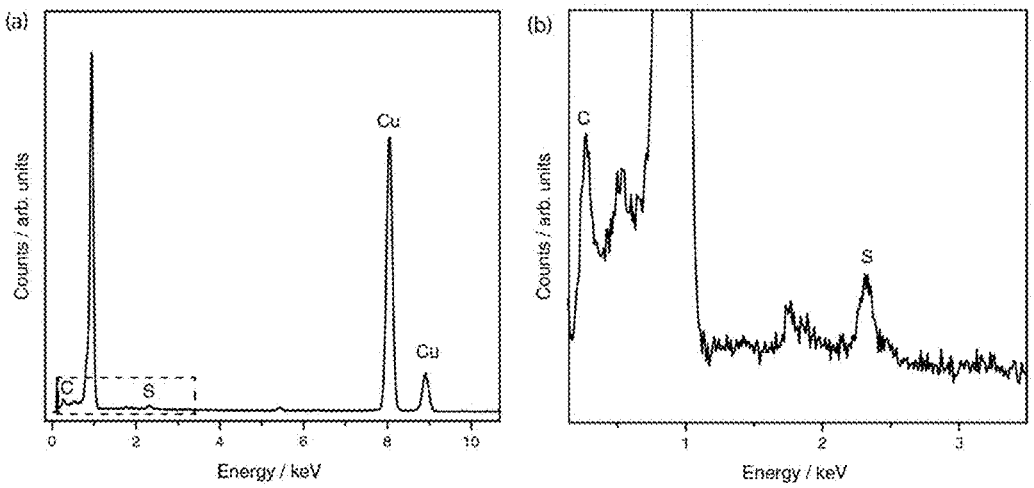

FIG. 4(*d*) is energy-filtered TEM using the C-K edge of an alkanethiol-treated Cu dendrite surface, the circle indicates the area used for TEM-XEDS analysis in FIG. 6.

FIG. 4(*e*) represents XPS spectra in the Cu region showing peaks assigned to I and II oxidation states of Cu.

FIG. 4(*f*) is XPS spectra in the S region showing presence of S on the alkanethiol-treated Cu surface.

FIGS. 4(*g*) and (*h*) show images of contact angle measurements of the wettable and hydrophobic dendrite electrodes respectively.

FIG. 4(*i*) is a SEM image of the hydrophobic dendrite electrode after 5 hours of varying applied cathodic potential electrolysis in 0.1 M $CsHCO_3$ with a $CO_2$ flow of 5 ml $min^{-1}$.

FIG. 4(*j*) is an illustration of the hydrophobic dendrite gaining a solid/liquid interface upon application of negative potential.

FIGS. 4(*k*), (*l*) and (*m*) show the equivalent images from (c) and (d) after electrolysis in $CO_2$-saturated $CsHCO_3$ (0.1 M, pH 6.8) for 25 minutes at −25 mA $cm^{-2}$.

Figure 5:
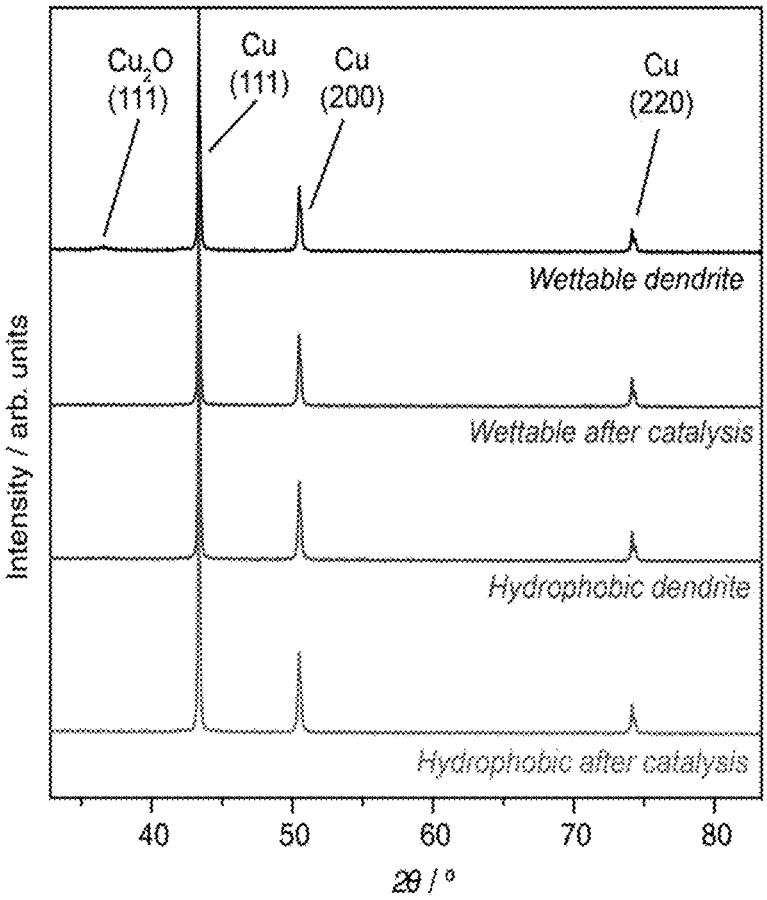

FIG. 5 represents Powder X-ray diffractograms of dendritic Cu with and without 1-octadecanethiol treatment before and after electrolysis in $CO_2$-saturated 0.1 M $CsHCO_3$ (pH 6.8, room temperature).

Figures 4A, 4B, 4C, 4D:
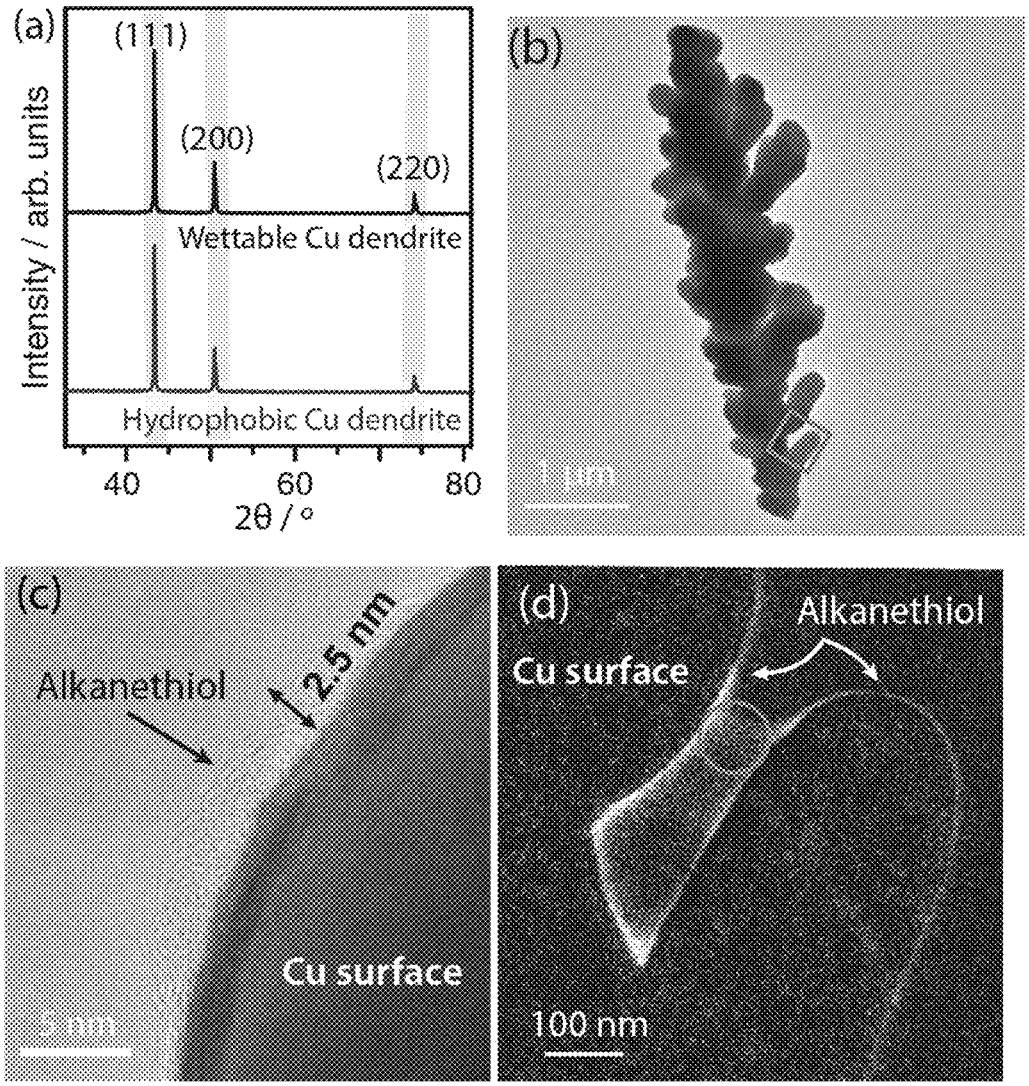
FIG. 4(*a*) represents the PXRD spectra of Cu dendrite with and without hydrophobic surface modification.

FIGS. 6(*a*) and (*b*) represent XEDS spectra of the 1-octadecanethiol-treated Cu dendrite electrodes during TEM scanning of the circle in FIG. 4*d*, showing C, S and Cu environments. (b) shows a close-up image of the area of the spectrum selected in (a).

Figure 7:
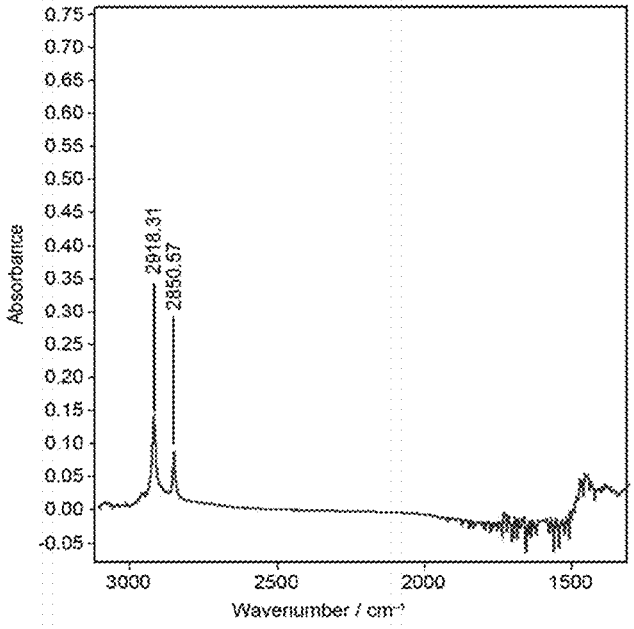

FIG. 7 is an ATR-FTIR difference spectrum of 1-octadecanethiol treated and non-1-octadecanethiol treated Cu-coated Si prism submerged in $CO_2$-saturated 0.1 M $CsHCO_3$ electrolyte, showing the presence of $CH_2$ and $CH_3$ groups.

Figure 8:
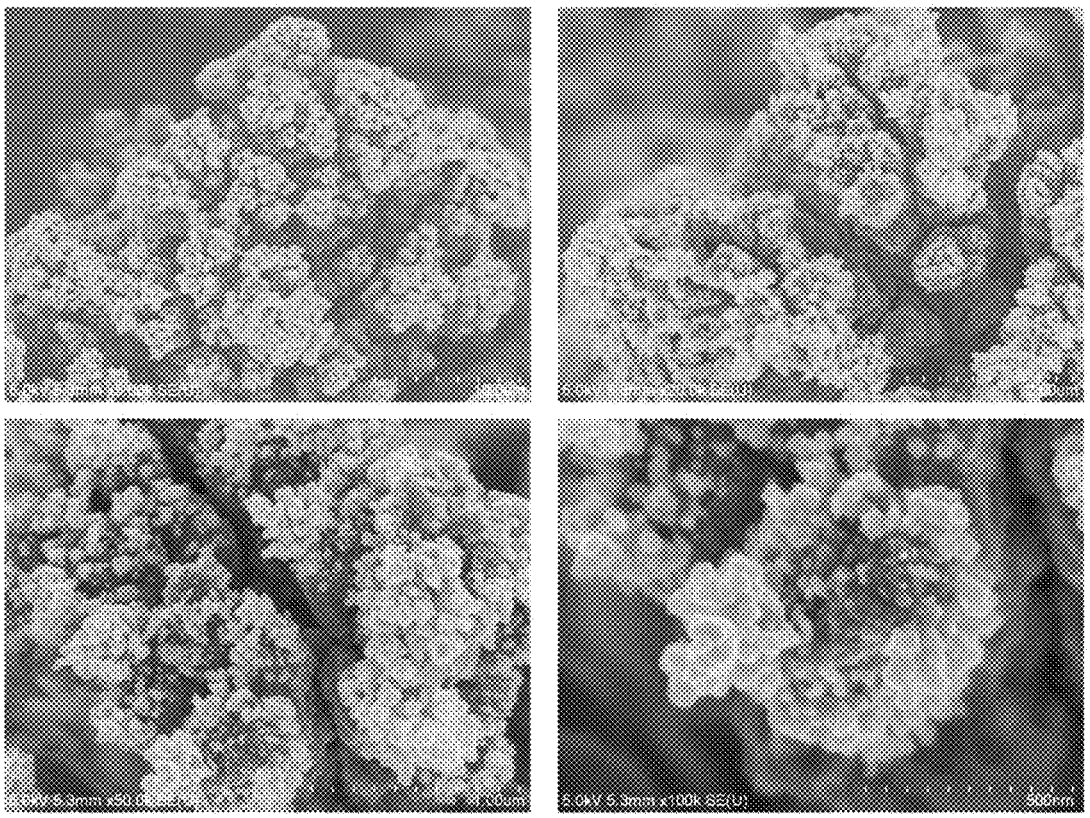

FIG. 8 represents SEM images at various magnifications of the hydrophobic dendrite electrode after 5 hours of varying applied cathodic potential in 0.1 M $CsHCO_3$ with a $CO_2$ flow of 5 ml $min^{-1}$, showing a clear bright region of 1-octadecanethiol-free Cu at the tips of the dendrite.

Figure 9:
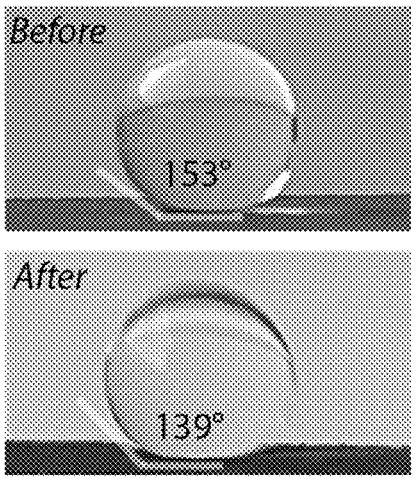

FIG. 9 represents images of contact angle measurements of hydrophobic Cu dendrite electrode before and after passing a current of −15 mA $cm^{-2}$ for 90 minutes.

FIG. 10(*a*) represents LSV of wettable and hydrophobic Cu dendrite (1 $cm^2$).

FIGS. 10(*b*) and (*c*) represent Faradic efficiency (%) of products formed at different controlled potential electrolysis of the wettable and hydrophobic dendrite electrodes.

FIG. 10(*d*) shows Faradic efficiency (%) of products formed with hydrophobic dendrite electrode after a controlled current electrolysis at −30 mA $cm^{-2}$ inside of and outside of the $CO_2$ flow.

FIG. 10(*e*) shows photos of the capture and release of a $CO_2$ bubble on the hydrophobic dendrite surface.

FIG. 10(*f*) shows Faradic efficiency FE (%) of products formed with the hydrophobic and wettable Cu dendrite electrodes when passing an overall current electrolysis of −30 mA $cm^{-2}$ in $CO_2$-saturated $CsHCO_3$ (0.1 M, pH 6.8) at a flow rate of 5 ml $min^{-1}$.

Figure 11:
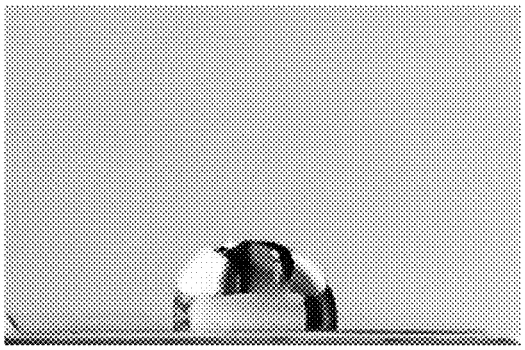

FIG. 11 is an image of contact angle measurements of hydrophobic flat Cu electrode; the measured angle is 90°.

FIGS. 12(*a*) and (*b*) show Faradic efficiency (%) of products formed at the hydrophobic Cu dendrite electrode when passing an overall current electrolysis of −30 mA $cm^{-2}$ in $CO_2$-saturated $CsHCO_3$ (0.1 M, pH 6.8) at a flow rate of 5 ml $min^{-1}$ for (a) simple products and (b) products with more than 1 carbon, where the dotted lines indicate when the electrode fell out of alignment with incident $CO_2$ bubbles, and where $H_2$ is present in both diagrams to show the relative activity of the desired vs. parasitic activity.

Figure 13:
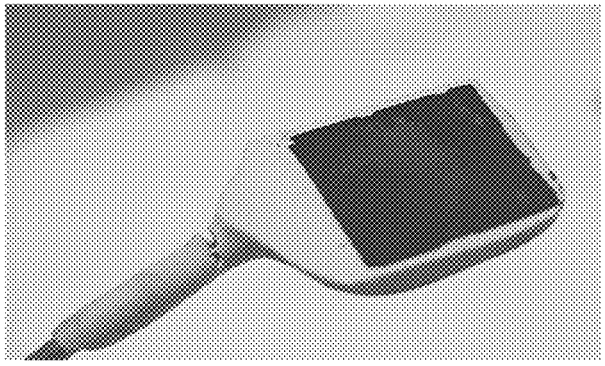

FIG. 13 shows a photo of the hydrophobic Cu dendrite electrode after 5 hours of electrolysis passing −30 mA $cm^{-2}$ showing regions of mechanical removal of dendrite.

Figures 14A, 14B:
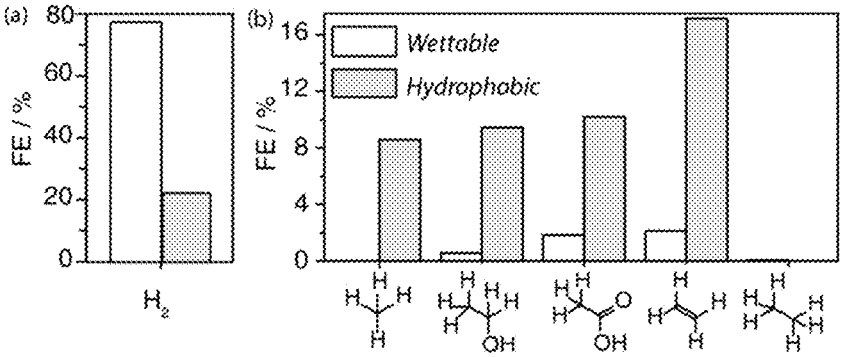

FIG. 14 represents Faradic efficiency (%) of products formed at controlled potential electrolysis after CO reduction at −1.4 V vs. RHE in 0.1 M $CsHCO_3$ under CO flow of 5 ml $min^{-1}$ over 35 minutes for (a) proton reduction and (b) CO reduction.

Figure 15:
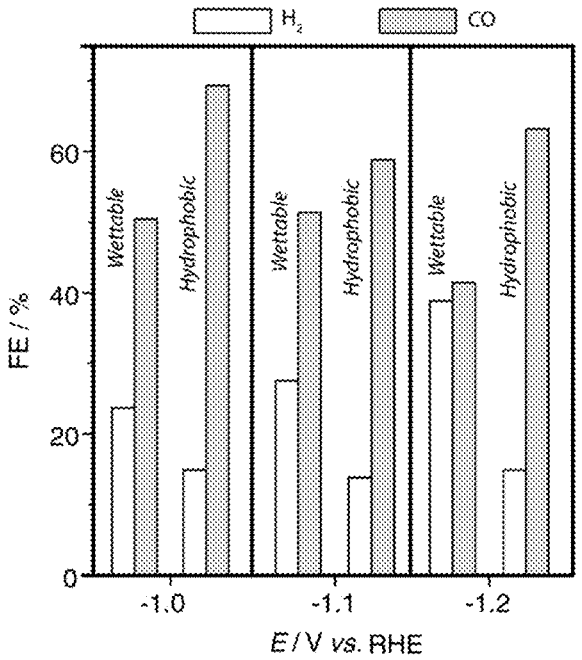

FIG. 15 represents Faradic efficiency (%) of products formed at different controlled potential electrolysis using a 1.3 $cm^2$ ZnAg alloy electrode with and without addition of 1-octadecanethiol at the surface (labelled hydrophobic and wettable respectively) in $CO_2$-saturated $CsHCO_3$ (0.1 M, pH 6.8)

Figure 16:
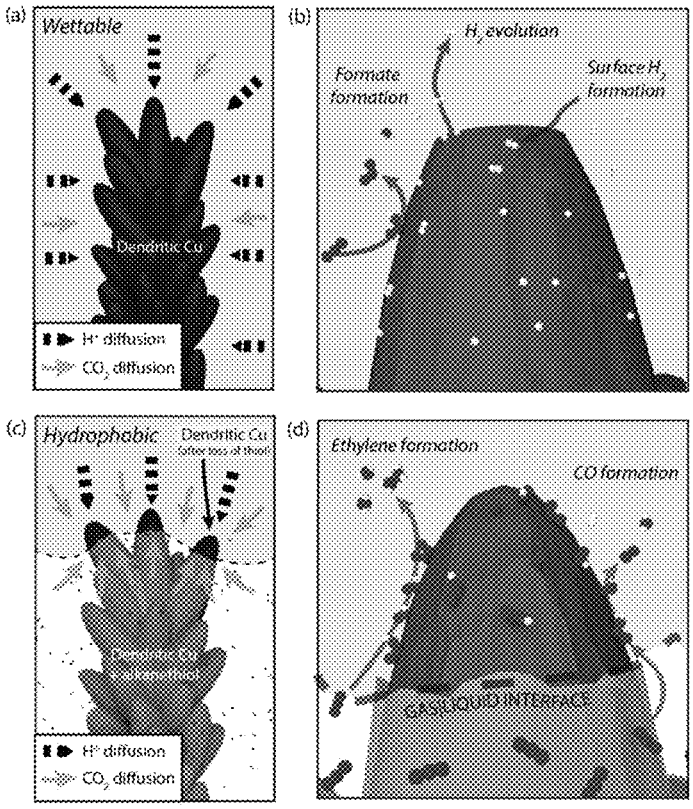

FIGS. 16(*a*) and (*b*) represent the wettable dendrite under operation, showing reactant diffusion and product formation on the electrode surface.

FIGS. 16(*c*) and (*d*) represent the operation of the hydrophobic dendrite, illustrating the gaseous layer trapped beneath the solution and the formation of key products on the surface.

Figure 17:
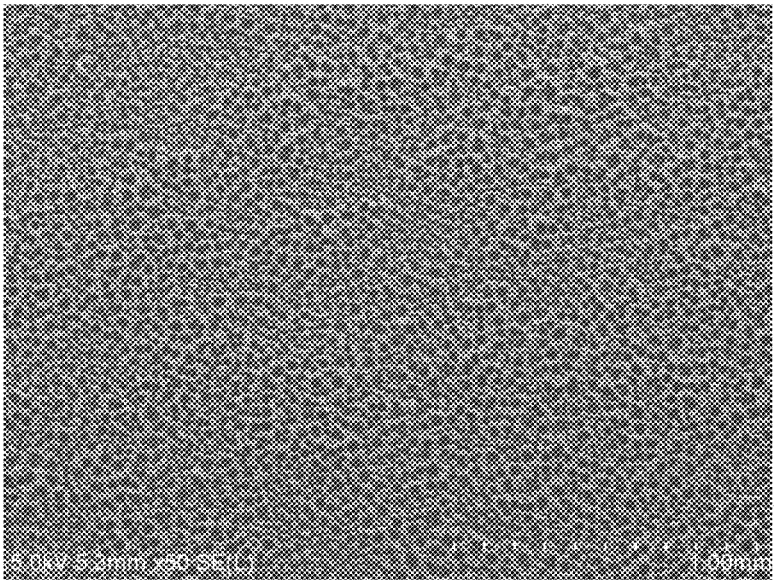

FIG. 17 illustrates the presence of pores being in the specific case of a dendritic copper hierarchical structure, as visualized by scanning electron microscopy (SEM).

Figure 18:
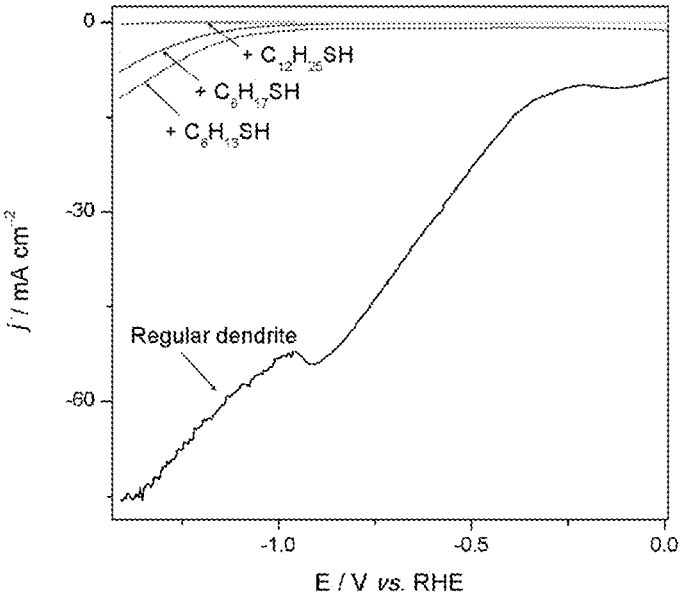

FIG. 18 represents the linear sweep voltammetry of Cu dendrites in $CO_2$-saturated $CsHCO_3$ on a 1 $cm^2$ electrode functionalized with different lengths of alkanethiol, according example 8.

FIGS. 19(*a*), (*b*) and (C) show the Faradaic yields for different products at varying applied potentials on Cu dendrites functionalized with (a) hexanethiol, (b) octanethiol and (c) no alkanethiol modification in $CO_2$-saturated 0.1 M $CsHCO_3$.

FIG. 19(*d*) represents the controlled potential electrolysis traces at −1.4 V vs. RHE with functionalized/unfunctionalized Cu dendrites in $CO_2$-saturated 0.1 M $CsHCO_3$.

Figures 20A, 20B, 20C, 20D:
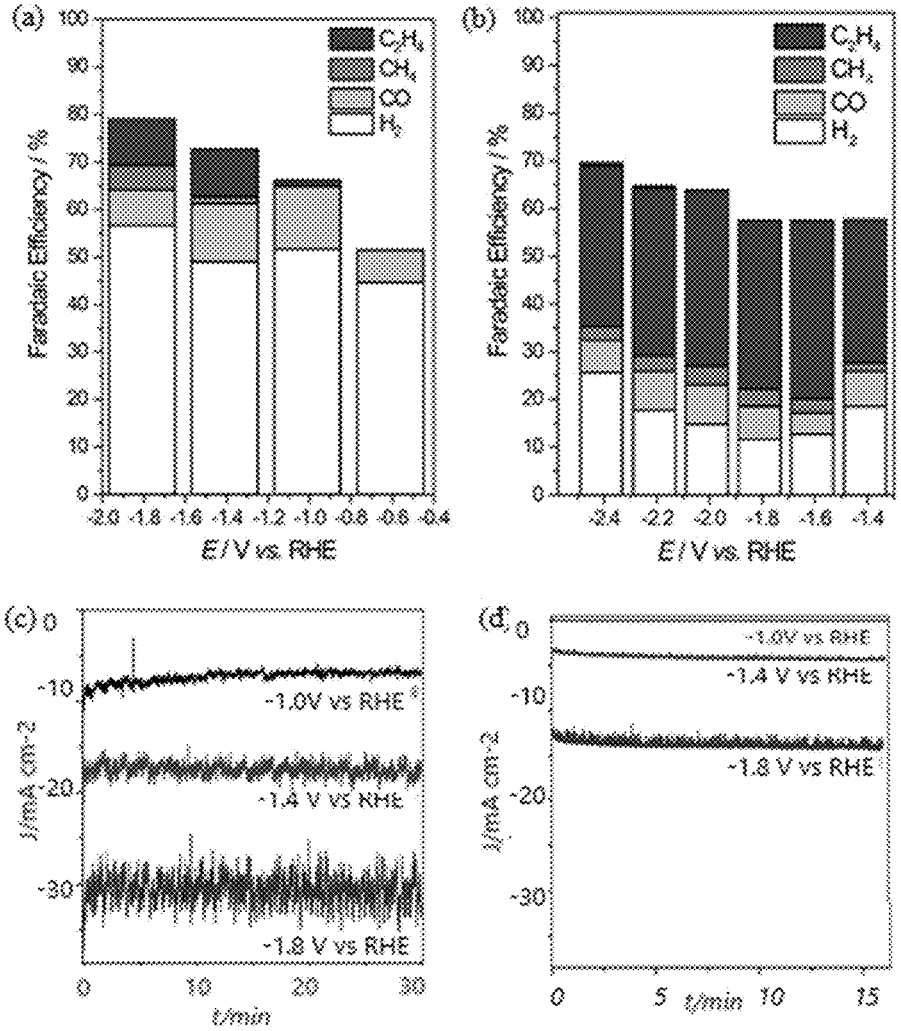

FIG. 20(*a*) and (*b*) illustrate the gaseous products and current-time traces at varying potentials of (a) unfunctionalized Cu dendrites and (b) dodecanethiol-functionalized Cu dendrites in $CO_2$-saturated 0.1 M $CsHCO_3$.

FIG. 20(*c*) and (*d*) represent the controlled potential electrolysis traces at −1.0 V, −1.4 V and −1.8 V vs. RHE with (d) dodecanethiol functionalized/(c) unfunctionalized Cu dendrites in $CO_2$-saturated 0.1 M $CsHCO_3$.

EXAMPLES

Abbreviations

- BET method: Brunauer, Emmett and Teller method
- SHE: Standard Hydrogen Electrode
- RHE: Reversible Hydrogen Electrode
- EASA: Electrochemically Active Surface Area
- LSV: Linear Sweep Voltammetry
- PXRD: Powder X-Ray Diffraction
- TEM: Transmission Electron Microscopy
- TEM-XEDS: TEM-XEDS Transmission Electron Microscopy—X-ray Energy Dispersive Spectroscopy
- XPS: X-Ray Photoelectron Spectroscopy
- ATR-FTIR spectroscopy: Attenuated Total Reflectance-Fourier Transform Infrared spectroscopy
- FE (%): Faradic Efficiency
- Wettable dendrite: Dendrite electrode without modification
- Hydrophobic dendrite: Dendrite electrode with surface modification
- CV: Cyclic voltammogram

Example 1: Cu Dendrites with an Alkanethiol Monolayer—Electrode Preparation 1.1 Preparation of Cu Dendrites (Electrodeposition Method)

Dendritic Cu electrodes were prepared from square Cu surfaces (GoodFellow, 99.999%, 1 mm) of 1 $cm^2$ surface area and the sides, back and electrical contact to the electrodes was encased in epoxy resin. The surface was polished mechanically using alumina micropolish on a polishing cloth, followed by copious rinsing in water.

Dendrite deposition was subsequently undertaken by applying −0.5 A $cm^{-2}$ to the electrode for 120 seconds with a Pt mesh anode in a solution containing 0.1 M $CuSO_4.5H_2O$ (99.9%, Sigma Aldrich) in 1.5 M $H_2SO_4$ (Sigma Aldrich) followed by rinsing under a gentle stream of water, then acetone.

Potentials were typically between −1.5 and −2.3 V vs. SHE.

5 mg of Cu dendrites is added during this process.

1.2 Alkanethiol Deposition—General Procedure

For solid alkanethiols the electrode to be treated was submerged into the melted alkanethiol under Argon and left for 15 minutes at 60° C. After this point the electrode was moved to a solution of ethyl acetate at 60° C. for 5 minutes to remove excess alkanethiol and allowed to dry in ambient conditions.

Deposition of liquid alkanethiols was undertaken by drop-casting each thiol onto the electrode to be treated until saturated, allowing the solution to rest for 5 seconds and subsequently rinsing with ethyl acetate.

1.3 Preparation of Cu Dendrites Comprising a 1-octadecanethiol Monolayer

Application of 1-octadecanethiol (98%, Sigma Aldrich) was undertaken by first melting the waxy solid under vacuum at 60° C. A Cu dendrite surface was then submerged into the liquid under Argon and left for 15 minutes at 60° C. After this point the electrode was moved to a solution of ethyl acetate at 60° C. for 5 minutes to remove excess 1-octadecanethiol and allowed to dry in ambient conditions.

Example 2: Electrochemical Surface Area Measurements

A—Method

Electrochemical surface area was found by measuring the capacitance of the electrodes in a 0.1 M solution of $CsHCO_3$ saturated with $CO_2$. Capacitance was measured by analysis of the electrode cyclic voltammogram at −0.15 V vs. standard hydrogen electrode (SHE) using Equation 1:

$$\frac{ia - ic}{2} = Cv \qquad \text{Equation 1}$$

Where C is the capacitance (F), $i_a$ is the anodic current at −0.15 V vs. SHE (A), $i_c$ is the cathodic current (A) and v is the scan rate. The capacitance was found by plotting the left side of Equation 1 against scan rate. Electrochemical surface area was then found by the difference between the capacitance of the nanostructured surfaces relative to a flat 1 $cm^2$ Cu surface.

B—Analysis of EASA

Figure 1A:
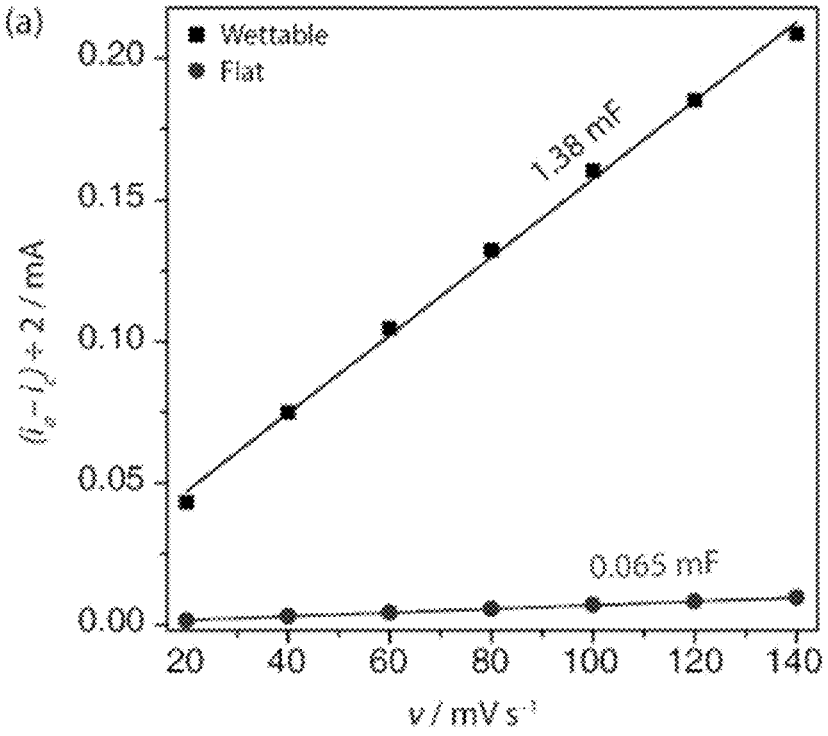
FIG. 1(*c*) represents EASA of wettable dendrite and hydrophobic electrodes based on the flat Cu electrode as reference. The hydrophobic dendrite EASA data are presented after various times periods of electrolysis in 0.1 M $CsHCO_3$ at a current of −15 mA $cm^{-2}$.
Figure 1B:
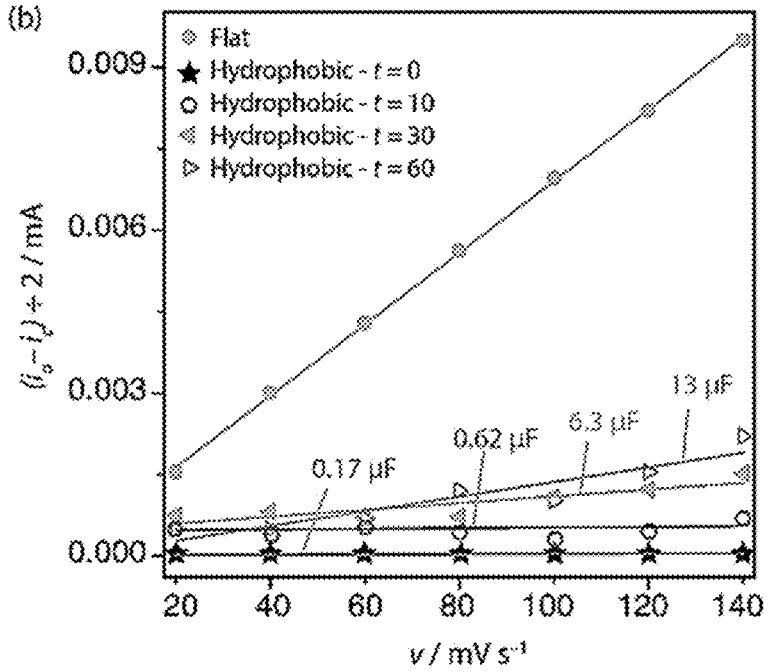
Figure 1C:
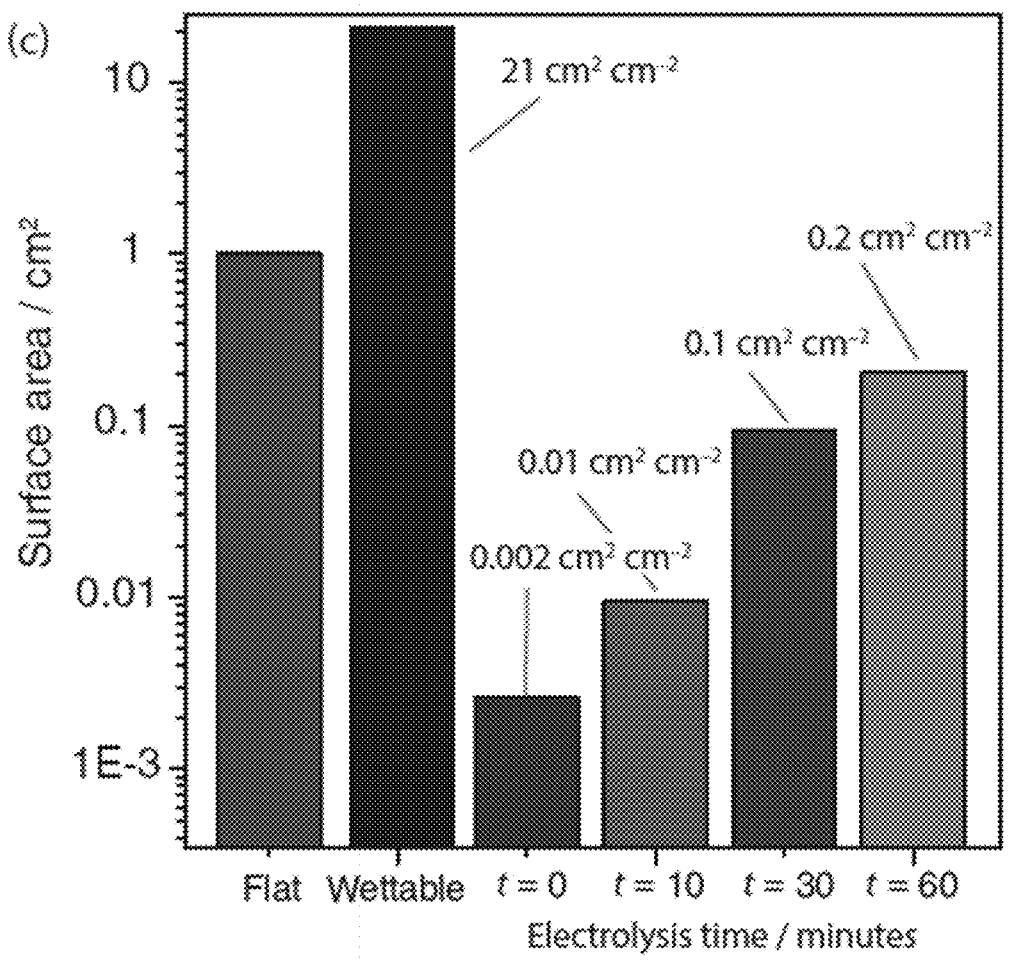

Initial characterization of the dendrites' electrochemical properties revealed a significant decrease in electrochemically active surface area (EASA) upon introduction of hydrophobicity. Capacitance measurements of the hydrophobic dendrite indicated the freshly prepared surface had very limited electrical contact with the solution, displaying an EASA of $3\times10^{-3}$ $cm^2$ $cm^{-2}$ (FIG. 1*c*), much lower than the 21 $cm^2$ $cm^{-2}$ obtained on the wettable dendrite.

Figures 2A, 2B:
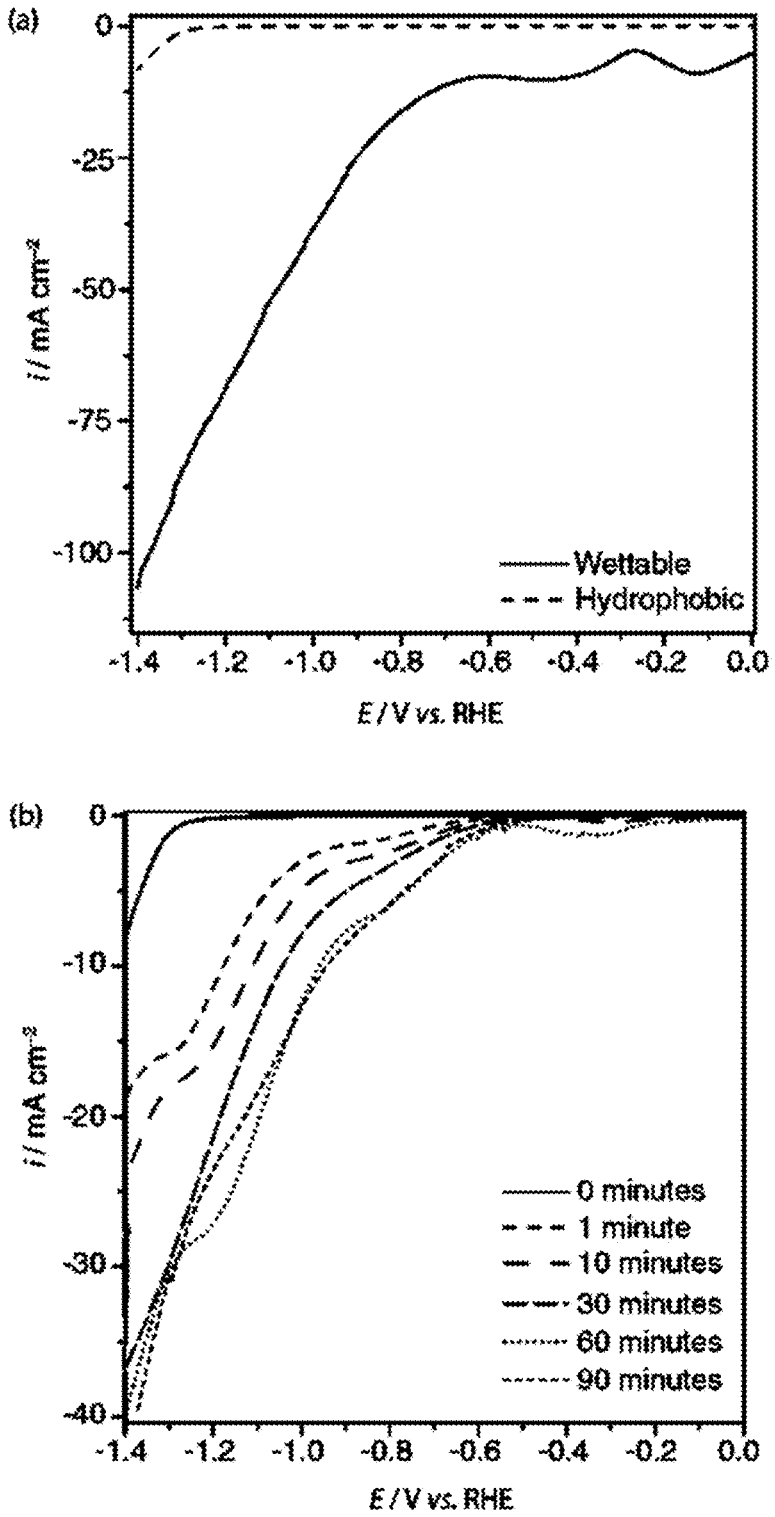
FIG. 2(*a*) is the linear sweep voltammetry (LSV) (v=20 mV $s^{-1}$) of a 1 $cm^2$ Cu dendrite electrode, with and without 1-octadecanethiol treatment in a two-compartment electrochemical cell with 0.1 M $CsHCO_3$ ($CO_2$-saturated, pH 6.8, room temperature).

Upon application of reducing potential over periods from 0 to 60 min, in aqueous electrolyte (0.1 M $CsHCO_3$, $CO_2$-saturated) the EASA of the hydrophobic dendrite electrode increased, reaching 0.2 $cm^2$ $cm^{-2}$ after 60 min electrolysis (FIG. 1*b*), which can also be seen through linear sweep voltammetry (LSV, FIG. 2). This is assigned to partial loss of the surface-bound alkanethiol; an expected result when reaching labile $Cu^0$ oxidation states.

Example 3: Cu Dendrites with Alkanethiol (1-Octadecanethiol) Monolayer—Surface and Morphology Characterizations A—Methods

BET

Surface areas of Cu dendrite were obtained from the analysis of Krypton absorption isotherms measured on a BelSorp Max set-up at 77 K (BEL instruments). Prior to the measurement, samples were treated under vacuum at 130° C. during at least 7 h. Surface areas were estimated using the BET model (Kr cross-sectional area 0.210 $nm^2$). The BET sample preparation by undertaking the above dendrite preparation on a large Cu surface (3×3 $cm^2$) to grow enough dendrite for measurement.

1-octadecanethiol treatment of the large surface was carried out by covering the surface in a powder of 1-octadecanethiol and inserting the resultant surface horizontally in a vacuum oven at 100° C. for 15 minutes. The electrode was subsequently removed and left in a bath of warm ethyl acetate 60° C. for 5 minutes. Once dry, the dendritic Cu was carefully scraped off the underlying Cu support for analysis. The value derived from BET measurement, reported in $m^2 \cdot g^{-1}$, was converted to $cm^2 \cdot cm^{-2}$ (geometric) by multiplying it by the mass of deposited electrode onto the 1 $cm^2$ flat Cu support (5 mg for wettable and 4 mg for hydrophobic dendritic Cu).

TEM: Transmission electron microscopy images and chemical maps were acquired with a Jeol 2100F microscope operated at 200 kV. TEM EDS spectra were acquired in STEM mode with the same microscope, equipped with Jeol system for X-ray detection and cartography. Samples for TEM were prepared by shaking a TEM grid in a vial containing a small amount of Cu dendrite powder.

ATR-FTIR: Attenuated total reflectance-Fourier transform infrared spectroscopy was carried on a 0.5 mm thick Si-prism coated with 3-5 nm of Cu in a metal vacuum-evaporation apparatus. ATR-FTIR was undertaken while the front of the prism was exposed either to $N_2$ or $CO_2$ gas or a solution of 0.1 M $CsHCO_3$, under $N_2$ or $CO_2$.

SEM: SEM images were performed on a SU-70 Hitachi FEGSEM fitted with an X-Max 50 $mm^2$ Oxford EDX spectrometer (Oxford instruments).

XRD: Powder XRD were performed in Bragg-Brentano geometry using a BRUKER D8 Advance diffractometer with Cu Kα radiation (λKα1=1.54056 Å, λKα2=1.54439 Å) and a Lynxeye XE detector.

XPS: XPS spectra were performed using a Thermo ESCALAB 250 X-Ray photoelectron spectrometer with a monochromatic Al-Kα X-ray source (hv=1486.6 eV).

Contact angle measurements: Contact angle measurements were made on a slow-motion video recorder with 15 μl of $H_2O$.

B—Cu Dendrites with alkanethiol (1-octadecanethiol) Monolayer—Freshly Prepared

Figure 3A:
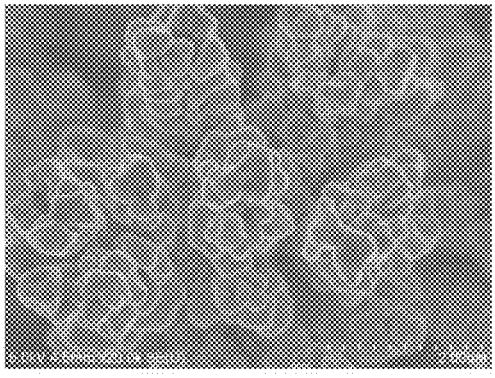
FIG. 3 are SEM images of Cu dendrites before electrolysis (a) with 1-octadecanethiol treatment and (b) without 1-octadecanethiol treatment.
Figure 3B:
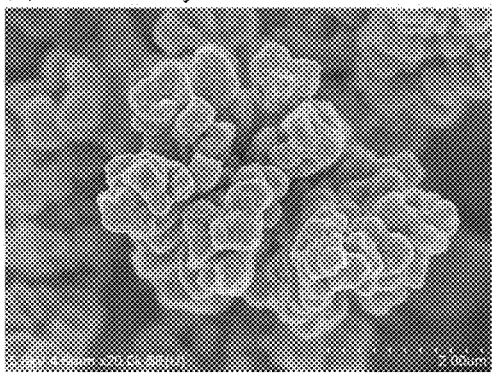

Cu dendrites form hierarchical architectures with both micro and nanoscale features as shown on SEM images (FIG. 3). Powder X-ray diffraction (PXRD) measurements confirmed the structure to be metallic Cu (FIG. 4*a*), although a small amount of $Cu_2O$ was visible (FIG. 5).

The hydrophobic treatment was undertaken by the formation of an alkanethiol layer on the electrode surface. High-resolution TEM (HR-TEM) images show the structure of a strand of the dendritic Cu (FIG. 4*b*) that is coated with a layer of 2-3 nm (FIG. 4*c*), consistent with a surface of 1-octadecanethiol molecules bound upright on the electrode surface (chain length is 2-3 nm between surface bound S and terminal C). A carbonaceous coating of the electrode was confirmed by energy-filtered transmission electron microscopy (EF-TEM) at the C-K edge, which also showed the alkanethiol treatment accumulated within micropores of the dendrite (FIG. 4*d*). Scanning transmission electron microscopy-energy-dispersive X-ray spectroscopy (STEM-EDS) of the area indicated in FIG. 4*d* displays S and C environments within the layer (FIG. 6), confirming the presence of the alkanethiol.

The alkanethiolation did not alter the structure of the underlying Cu, as confirmed by powder X-ray diffraction (PXRD) measurements and SEM images (FIG. 4*a* and FIG. 3). Nevertheless, the treatment removes oxide from the surface, leaving only Cu—S bonds, as illustrated by X-ray photoelectron spectroscopy analysis (XPS, FIG. 4*e*, Table 1). This is in agreement with previously reported thiol-induced reduction of surface copper-oxide layers. The untreated Cu dendrite shows environments consistent with metallic $Cu^I$ at 932.5/952.4 eV, as well as peaks at 934.6/955.0 eV and 942.8/962.7 eV assigned to CuO. XPS of the thiolated electrode also shows S 2p peaks at 162.7 eV and 163.8 eV, which is consistent with the reported S 2p value of Cu—S bonds (FIG. 4*f*). The presence of the alkanethiol layer was further confirmed through attenuated total reflectance infrared (ATR-IR) spectroscopy, which showed the presence of surface $CH_2$ and $CH_3$ functionality on a Cu-coated Si prism treated with 1-octadecanethiol in electrolyte solution (FIG. 7).

TABLE 1

XPS analysis of 1-octadecanethiol-coated Cu dendrite electrode before electrolysis

| Element (orbital) | Atomic / % | Chemical assignment | Binding energy / eV | Atomic / % | Assignment / % |
|---|---|---|---|---|---|
| C(1s) | 81.7 | C—C | 285.3 | 100 | 81.7 |
| | | Cu—O | 530.7 | 54.7 | 3.9 |
| O(1s) | 7.1 | Cu—OH | 531.7 | 5.7 | 0.4 |
| | | Bonded water | 532.9 | 39.6 | 2.8 |
| Cu(2p) | 7.1 | Cu | 932.8 | | 7.1 |
| S(2p) | 4.1 | S—Cu | 162.7 | 78.2 | 3.2 |
| | | S—Cu | 163.2 | 21.8 | 0.9 |

Contact angle measurements illustrated that without modification the Cu dendrite surface is hydrophilic; a deposited water droplet sat with a small contact angle of 17° (FIG. 4*g*). The alkanethiol-treated electrode is not susceptible to the same wetting, with a drastically increased contact angle of 153° (FIG. 4*h*), falling into the regime of superhydrophobicity. For clarity, and as already mentioned, these electrodes will be referred to as wettable dendrite and hydrophobic dendrite for the hydrophilic and hydrophobic dendritic Cu surfaces respectively. When submerged, the hydrophobic dendrite displays a reflective appearance reminiscent of the spider plastron as gas bubbles are trapped on the surface.

Figures 4J, 4L:
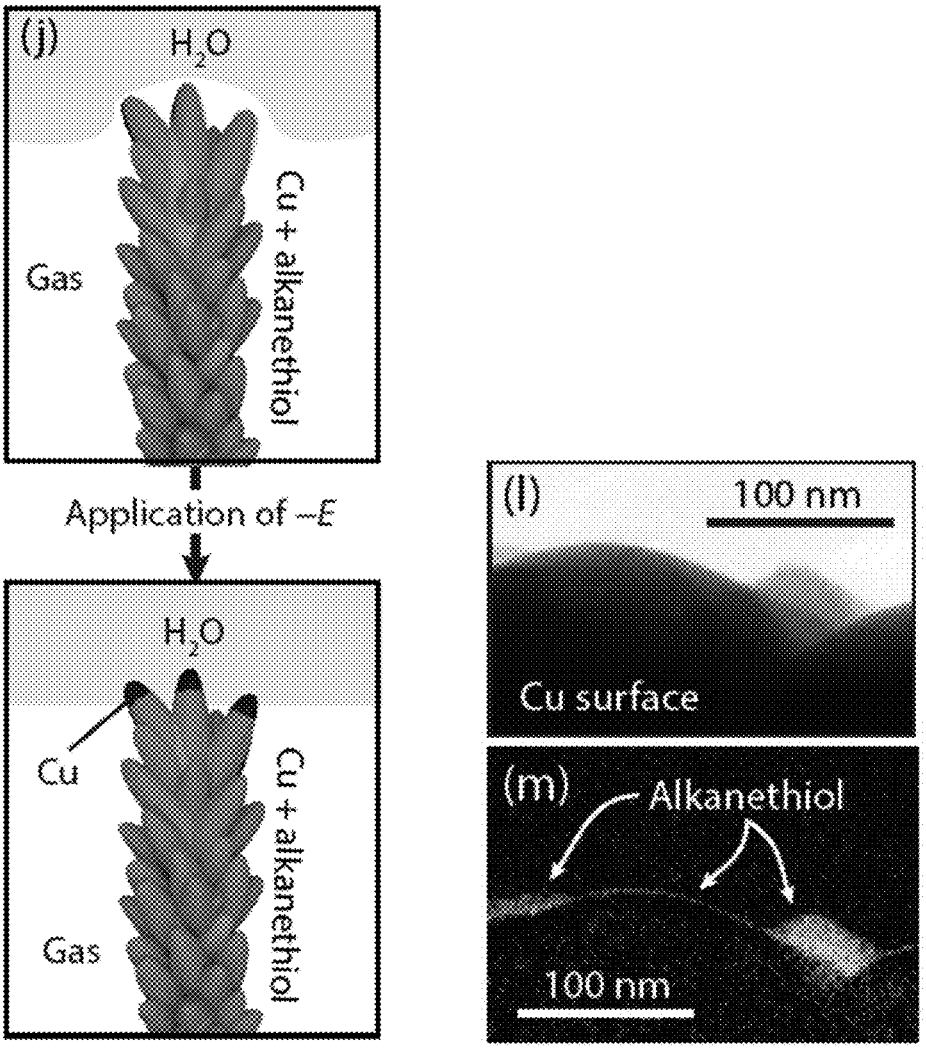

BET analysis through Kr adsorption revealed that the EASA disparity is not from a loss in geometric surface upon alkanethiol treatment, as the geometric surface areas are near identical within error: 90 $cm^2$ $cm^{-2}$ and 92 $cm^2$ $cm^{-2}$ for the wettable dendrite and hydrophobic dendrite, respectively, which agrees with the SEM analysis (FIG. 3). The decrease in EASA is therefore induced by loss of electrical contact at the interface between the hydrophobic dendrite and solution, as illustrated in FIG. 4*j*.

C—Cu Dendrites with alkanethiol (1-octadecanethiol) Monolayer—after a First Electrocatalysis or Post Catalysis The loss of alkanethiol can be seen in the SEM imaging after application of potential, which shows exposed Cu at the highest points of the dendrite (FIG. 4*i*), brighter regions) and alkanethiolated Cu underneath (darker regions, see FIG. 8). The hydrophobic dendrite therefore requires an initial application of potential to generate a solid-liquid interface at the highest points of the dendrite, as illustrated in FIG. 4*j*. The loss of alkanethiol was further confirmed by TEM imaging after application of potential, which shows a decrease in the size of the surface layer by around 1.5 nm, consistent with the alkanethiol losing density and flattening against the Cu surface (FIG. 4*k*). Energy-filtered TEM and XPS analysis confirmed that a large portion of surface-bound alkanethiol is still present after passing current (FIGS. 4*l* and *m* and Table 2) and the electrode remained hydrophobic (FIG. 9).

TABLE 2

XPS analysis of 1-octadecanethiol-coated Cu dendrite electrode after electrolysis*

| Element (orbital) | Atomic / % | Chemical assignment | Binding energy / eV | XPS atomic / % | Assignment / % |
|---|---|---|---|---|---|
| C(1s) | 72.1 | C—C | 285.1 | 85.4 | 63.9 |
| | | C—O | 286.1 | 14.6 | 8.2 |
| | | C=O | — | — | — |
| | | O—C=0 | — | — | — |
| O(1s) | 15.2 | Cu—O | 530.6 | 30.6 | 4.7 |
| | | Cu—OH | 531.6 | — | |
| | | $C_xO_y$ | 531.6 | 48.1 | 7.3 |
| | | Bonded water | 532.7 | 21.3 | 3.2 |
| Cu(2p) | 6.3 | Cu(I) | | 49.2 | 3.1 |
| | | Cu(II) | | 50.8 | 3.2 |
| S(2p) | 5.5 | S—Cu | 165.5 | 49.5 | 2.4 |
| | | $SO_x$ | 168.9 | 50.5 | 2.5 |
| Cs(3d) | 1.0 | | | | 1.0 |

*Electrolysis carried out by passing −30 mA $cm^{-2}$ through the electrode in 0.1 M $CsHCO_3$ catholyte ($CO_2$ saturated, pH 6.8) and 0.2 M $Cs_2CO_3$, separated by a Nafion membrane.

Example 4: Comparison Between Wettable and Hydrophobic Cu Dendrite Electrode

A—Method: Electrocatalytic Analysis

Electrochemical analysis was carried out in an air-tight two-compartment electrochemical cell separated by a Nafion membrane (Alfa Aesar, N115). The counter electrode was a Pt wire (Goodfellow) and the reference an Ag/AgCl wire in NaCl (3 M NaCl). 0.1 M $CsHCO_3$ (Sigma Aldrich) was used as the electrolyte in all experiments and was de-aerated and saturated with $CO_2$ before each experiment by bubbling $CO_2$ (≥99.998%, Linde) for at least 10 minutes at 5 ml $min^{-1}$.

During electrolysis, the electrodes were placed at a 45° incidence to the $CO_2$ inlet. $CO_2$ was flowed through the cathode compartment of the cell at a rate of 5 ml $min^{-1}$ using a mass flow controller (Brooks Instruments) and the solution was stirred intensely. The headspace was connected to a gas chromatograph (GC, discussed below) and was sampled periodically. The liquid phase was also sampled periodically and analyzed for products by $^1$H-NMR. Faradaic efficiency was calculated based on the time before injection that was required to fill the GC injector sample loops (1 mL). This is summarized in Equation 2.

$$\text{Faradaic efficiency (\%)} = \frac{n(\text{product}) \times n(\text{electrons})}{(Q_{t=0} - Q_{t=x})} \times 100 \qquad \text{Equation 2}$$

where n(product) is the product measured (mol), n(electrons) is the number of electrons to make said product from $CO_2/H_2O$, F is the Faraday constant (C $mol^{-1}$), $Q_{t=0}$ is the charge passed at the point of injection (C) and $Q_{t=x}$ is the charge passed at x seconds before injection, (x being the time required to fill the GC sample loop based on sample loop size and $CO_2$ flow rate, C).

Gas chromatography: Gas chromatography was carried out on a SRI instruments GC with Ar carrier gas. $H_2$ was quantified using a thermal conductivity detector and separated from other gases with a HaySepD precolumn attached to a 3 meter molecular sieve column. All carbon-based products were detected using a flame-ionization detector equipped with a methanizer and were separated using a 5 m HaySepD column. Calibration was performed by injecting a custom mixture of each gas in $CO_2$.

$^1$H-NMR: $^1$H-NMR spectroscopy was undertaken on a Bruker Avance III 300 MHz spectrometer at 300 K. A sample of the liquid phase electrolyte was taken and $D_2O$ was added as a locking solvent along with an aqueous terephthalic acid solution that served as a reference for quantification. A Pre-SAT180 water suppression method was carried out to remove the water peak from each spectrum.

B—Comparison between Wettable and Hydrophobic Cu Dendrite Electrode

Figures 10A, 10B, 10C:
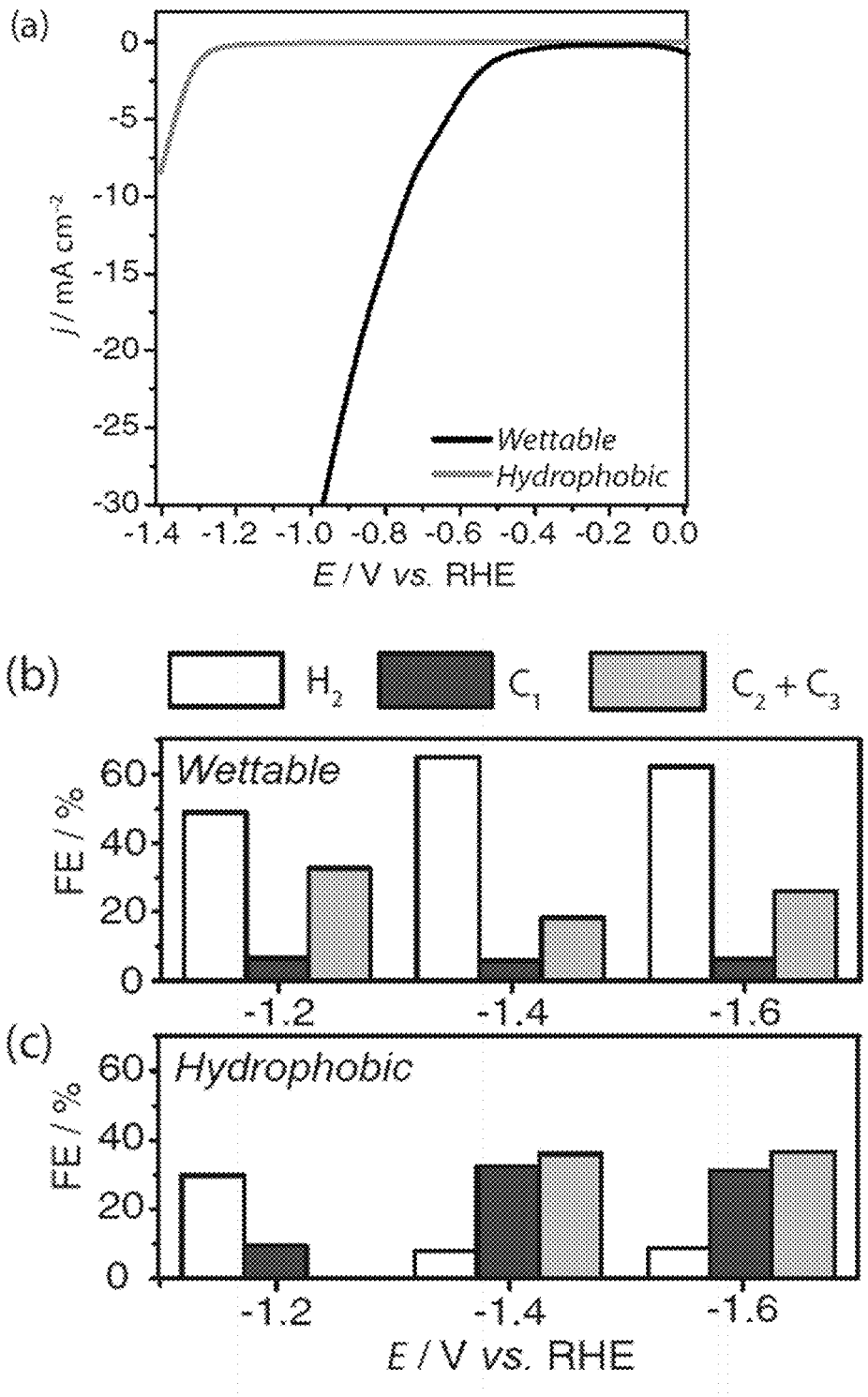

FIG. 10*a* shows the LSV of the hydrophobic dendrite and equivalent wettable dendrite in $CO_2$-saturated $CsHCO_3$ electrolyte (0.1 M, pH 6.8). $CsHCO_3$ electrolyte was used as $Cs^+$ cations buffer pH changes at the electrode I solution interface during electrolysis, thereby eliminating surface pH as a determinant on the electrode's selectivity. The wettable dendrite displays a rapid current onset after −0.5 V vs. RHE, while the hydrophobic dendrite activity starts much more negative, at −1.2 V vs. RHE. The lowered current of this electrode can be partly explained by the significantly lower EASA of the hydrophobic dendrite, however the increased onset potential is assigned to the lack of proton reduction activity exhibited by this electrode. Controlled potential electrolysis (CPE) in the aforementioned conditions confirmed this, as even at highly cathodic potentials the hydrophobic dendrite has vastly lowered $H_2$ evolution activity: At −1.6 V vs. RHE, the hydrophobic dendrite displays $H_2$ evolution activity below 10%, while the wettable displays values above 60% (FIGS. 9*b* and 9*c*). In place of $H_2$ evolution, the hydrophobic dendrite shows superior $CO_2$ reduction activity for both $C_1$ and $C_2$ at all potentials, except for its onset potential ('1.2 V vs. RHE), at which point it is current is too low for $C_2$ product detection (FIGS. 10*b* and 10*c*).

Figure 10D:
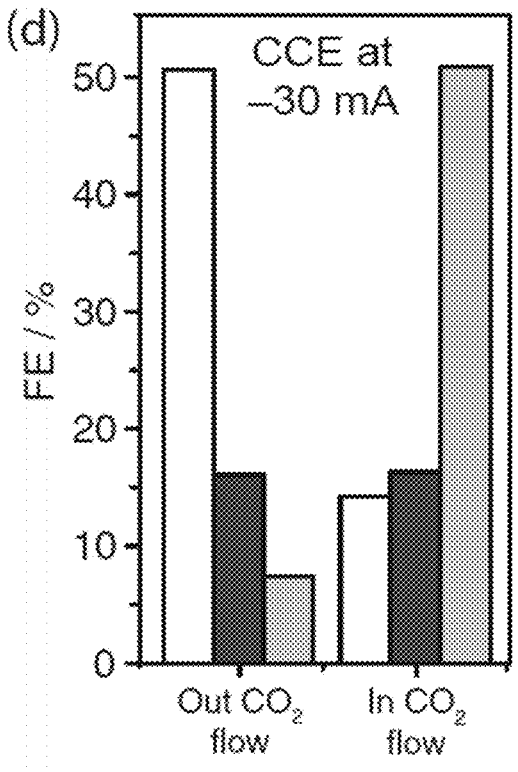
Figure 10E:
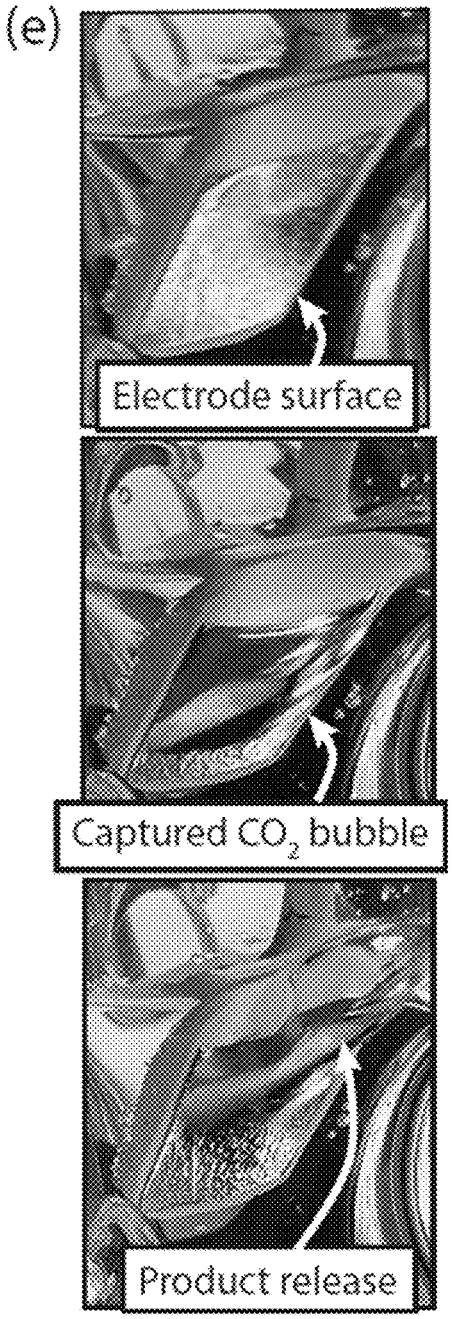
Figure 10F:
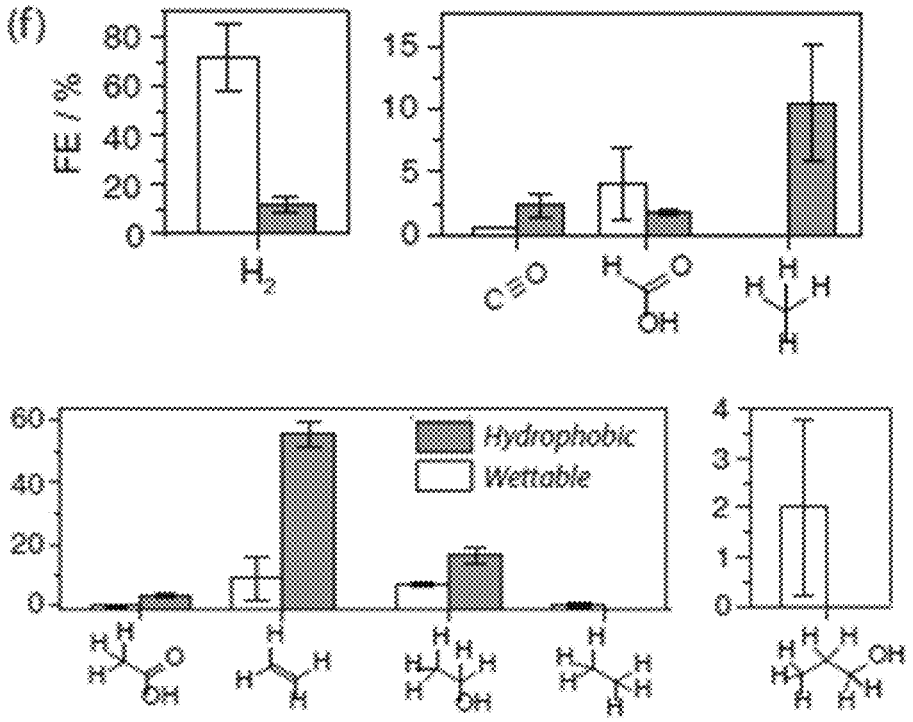

During electrolysis with the hydrophobic dendrite the capture and retention of gaseous $CO_2$ was observed, causing a bubble to engulf the entire electrode surface (FIG. 10*e*). If the gas flow was not incident to the hydrophobic dendrite to constantly refill this bubble, formation of $C_1$ and $C_2$ products was severely reduced, even though the solution was saturated with $CO_2$ (FIG. 10*d*). Control experiments without hierarchical Cu surface morphology were undertaken using a flat Cu electrode treated with 1-octadecanethiol. Neither gas trapping nor hydrophobic contact angles were observed in this case (contact angle: 90°, FIG. 11) and the electrode did not show a drastic increase in selectivity for $CO_2$ reduction compared to a pristine Cu electrode (see Table 3 for results from controlled current electrolysis at −3 mA $cm^{-2}$). The combination of hydrophobic treatment and hierarchical morphology therefore facilitate gas trapping, confirming the analogy with arachnid plastrons, which drastically increases the surface $CO_2$ concentration.

TABLE 3

Product analysis from controlled current electrolysis of various Cu electrodes*

| Electrode | Area/ $cm^2$ | j/mA $cm^{-2}$ | t/ minutes | E/V vs. RHE | Faradaic efficiency/% $H_2$ | CO | HCOOH | $CH_4$ | $H_3CH_2COH$ | $C_2H_4$ | $C_2H_6$ |
|---|---|---|---|---|---|---|---|---|---|---|---|
| Flat Cu | 1 | −3 | 35 | −1.0 | 57.5 | 3.8 | 13.3 | — | — | 1.5 | — |
| Flat Cu + octadecanethiol | 1 | −3 | 35 | −1.1 | 42.0 | 14.3 | 5.8 | 2.4 | 3.9 | 6.1 | — |

*Electrolysis carried out in 0.1M $CsHCO_3$ ($CO_2$-saturated, pH 6.8) separated by a Nafion membrane.

Controlled current electrolysis (CCE) at −30 mA $cm^{-2}$ for the two Cu dendrites was undertaken to understand their selectivity while exerting the same diffusive pressure on the solution (FIG. 3*f*). The hydrophobic dendrite required a higher cathodic applied potential to reach −30 mA $cm^{-2}$ (E=−1.4 V--1.5 V vs. RHE, with Ohmic drop correction), but had much higher selectivity for $CO_2$ reduction: CO (2% hydrophobic; 1% wettable), methane (10% hydrophobic; 0% wettable), ethylene (55% hydrophobic; 9% wettable) ethanol (16% hydrophobic; 2% wettable) and acetic acid (4% hydrophobic; 0.5% wettable). In contrast, the wettable dendrite required a lower potential to reach −30 mA $cm^{-2}$ (E=−0.8 V--1.0 V vs. RHE—with Ohmic drop correction) as it carried out mostly $H_2$ evolution (12% hydrophobic; 71% wettable), however it also showed the highest selectivity for formate (2% hydrophobic; 7% wettable), ethane (0% hydrophobic; 0.5% wettable) and propanol formation (0% hydrophobic; 2% wettable).

Figures 12A, 12B:
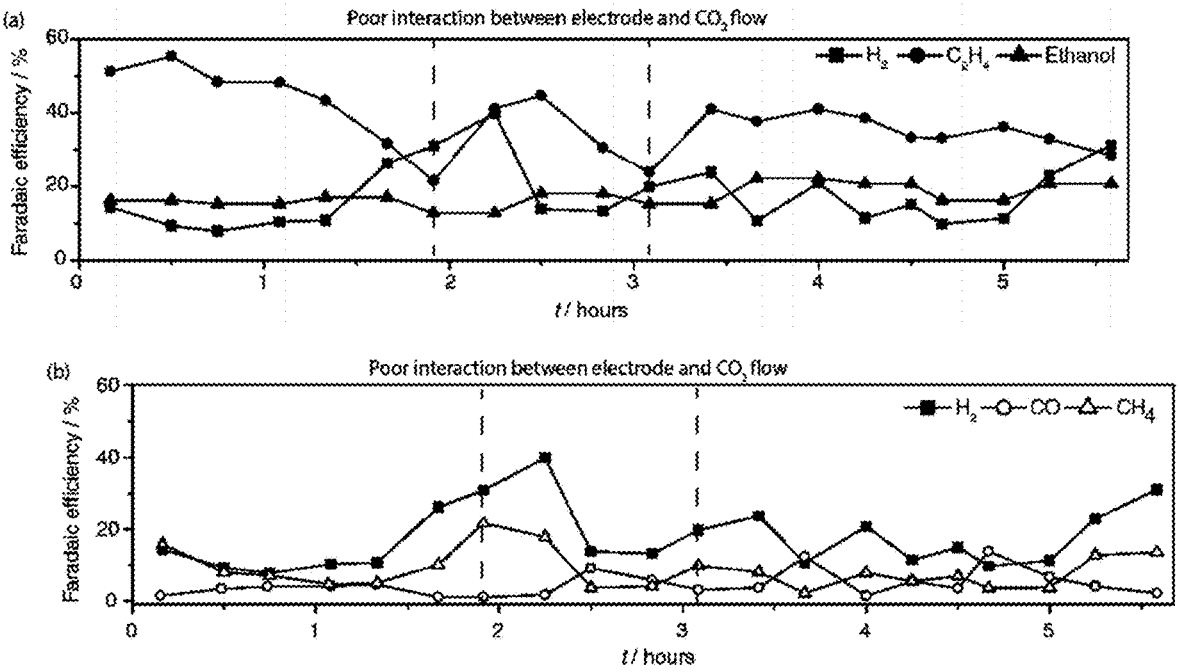

Extended $CO_2$ electrolysis of the hydrophobic dendrite over 5 hours at a controlled current density of −30 mA $cm^{-2}$ showed a high ethylene and ethanol efficiency of 30%-55% and 12-20% respectively (FIG. 12*a*). During the experiment, $C_2$ product formation was again sensitive to interaction with inbound $CO_2$ and drops in $C_2$ production were observed when $CO_2$ flow fell out of line with the electrode surface (FIG. 12, as indicated), however the stream could be adjusted to restore activity. Despite this, a gradual decrease in $C_2$ production activity was apparent as the experiment progressed, coinciding with destruction of regions of the dendrite surface. This is assigned to the mechanical stress imposed by continual collision of $CO_2$ bubbles with the electrode surface (FIG. 13).

The gas-trapping of the hydrophobic dendrite could also be exploited for CO reduction, where low substrate concentration is particularly problematic ([CO]=1 mM vs. [$CO_2$]=33 mM, 1 atm. of gas at room temperature). FIG. 14 shows the CO reduction activity of the wettable and hydrophobic electrodes at −1.4 V vs. RHE, at which point the hydrophobic dendrite shows 37% efficiency for $C_2$ formation (17% ethylene, 10% ethanol and 9% acetic acid). On the other hand, the wettable dendrite had little interaction with the substrate, showing CO reduction efficiency of 2.3% vs. 77% $H_2$.

In summary, a hydrophobic coating of long-chain alkanethiols on dendritic Cu promotes a significant increase in $CO_2$ reduction selectivity, particularly towards $C_2$ products.

Example 5: Zn and Ag Based Electrode with and without 1-octadecanethiol Monolayer Method Electrolysis was carried out using a dendritic hierarchical nanostructured Zn electrode alloyed with 5% Ag.

Deposition was carried out on a flat Zn electrode using 0.19 M $ZnSO_4$ and 0.01 $AgNO_3$ in 1.5 M $H_2SO_4$ by applying a controlled current of −4 A for 30 seconds. After deposition the electrode was rinsed in water.

1-Octadecanol coating was performed as reported in example 1.

B—Analysis of the Influence of 1-octadecanethiol on a ZnAg-Alloyed Electrode

In FIG. 15, at the applied potentials (−1.0 V, −1.1 V and −1.2 V), the electrode coated with 1-octadecanethiol shows superior activity for CO production relative to $H_2$. This is particularly true at the higher potential (−1.2 V vs. RHE), where $H_2$ decreases from 38% to 14% upon addition of 1-octadecanethiol and the CO increases from 42% to 63% Faradaic efficiency.

This example illustrates that the method of the invention to increase the surface hydrophobicity of an electrode, allows $CO_2$ reduction selectivity to be controlled and improved on various electrode surfaces, not only for Cu dendrite electrodes but also for Zn and Ag metallic nanostructured electrodes.

Example 6: Zn, Ni, Fe, W, Ag or Mixtures Thereof of Hierarchical Structure Electrodes and Monolayer Formation Preparation of the Metallic Hierarchical Structures Hierarchical structures of other metals, such as Zn, Ni, Fe and Ag, are prepared through electrodeposition procedures. In this case a metallic salt is dissolved in 1.5 M $H_2SO_4$ at a concentration of 0.1 M-0.2M. This solution is added to a cell into which a conducting support such as a metal slide or a carbon electrode are added with a Pt counter. A current is applied in the range of −0.5 A--4 A cm2 continuously for 1-2 minutes. This process builds hierarchical structures on the conducting support, which is then rinsed thoroughly with water to remove the excess salt.

Monolayer Formation 1-octadecanethiol

The produced electrode is submerged into liquid 1-octadecanethiol at 60° C. under vacuum for 15 minutes to deposit a hydrophobic surface layer and is rinsed with warm ethyl acetate to remove excess coating.

Liquid Alkanethiols

Deposition of liquid alkanethiols was undertaken by drop-casting each thiol onto a hierarchically structured surface until saturated, allowing the solution to rest for 5 seconds and subsequently rinsing with ethyl acetate.

Electrocatalysis

The prepared electrode is tested in an electrochemical cell containing 0.1 M $CsHCO_3$ electrolyte in which $CO_2$ gas is flowed and electrolysis is carried out at reducing potentials more negative than −1 V vs. RHE for several minutes.

Gas chromatography of the resultant produced gases show increased selectivity for $CO_2$ reduction during electrocatalysis, i.e. much less hydrogen is produced.

Example 7: Multilayer Formation

Onto a hierarchically-structured metal surface is deposited a solvent solution containing 1 mM of compound with long carbon chain (>C20 carbon chain) via drop-casting. The solvent evaporates off the surface, forming multiple layers of deposited compound on the hierarchically-structured surface.

Alternatively, multilayers are made through submersion of a hierarchical structure into a solution containing a monomer of silane in organic solvent (such as $Me_3SiCl$). The solution is gently heated to encourage polymerization of the silane monomers which bond with both the metal surface and each other, building up multiple layers on the surface. After polymerization the hierarchical surface is added to an organic solvent to remove unreacted silane.

Example 8: Influence of the Chain Length

A Cu-surface with deposited dendrites (as described in example 1) was functionalized with alkanethiol by drop-casting a thin film of the alkanethiol liquid onto the surface and leaving for 5-10 minutes. The surface was then washed with ethyl acetate at 60° C. to remove excess alkanethiol and allowed to dry in ambient conditions.

Three electrodes were prepared using 1-hexanethiol, 1-octanethiol and 1-dodecanethiol respectively. Table 4 shows the faradaic efficiencies for $C_2H_4$ formation and corresponding potentials vs. RHE by the different alkanethiol-functionalized copper dendrites in $CO_2$-saturated 0.1 M $CsHCO_3$. It was thus shown that the efficiency of $C_2H_4$ formation increased in the presence of hydrophobic compounds as compared to the wettable dendrite, devoid of hydrophobic layer.

TABLE 4

Comparison of peak Faradaic efficiencies for $C_2H_4$ formation and corresponding potentials vs. RHE

| Alkanethiol | E / V vs. RHE | $FE_{C2H4}$ (%) |
|---|---|---|
| No alkanethiol | −1.4 | 9.9 |
| Hexanethiol | −1.4 | 18.8 |
| Octanethiol | −1.8 | 18.0 |
| Dodecanethiol | −1.8 | 37.3 |

Electrochemical reactions were carried out using each electrode according to the procedure of example 4. The results are shown in FIGS. 18, 19 and 20. It can be concluded that the efficiency of $C_2H_4$ formation increased in the presence of hydrophobic compounds as compared to the wettable dendrite, devoid of hydrophobic layer. FIG. 18 illustrates that the addition of hydrophobic-alkanethiols to the Cu dendrites decreases the electrochemical response of the electrode visible in the linear sweep voltammetry, with the longer alkanethiol decreasing the current more significantly. The decrease in current indicates that less electrode surface is in contact with the electrolyte when hydrophobic compounds are added and therefore more $CO_2$ gas trapped in hydrophobic regions of the Cu dendrite. FIG. 19 shows that when using Cu dendrites that are functionalized with alkanethiol chains between 6 and 8 carbons in length during $CO_2$ reduction electrolysis, an increase in the dendrite's $C_2H_4$-production activity is seen, indicating that the trapped $CO_2$ gas on the more hydrophobic surface is increasing the $CO_2$ reduction activity. This is further confirmed in FIG. 20 where an alkanethiol of 12 carbons in length is added. This compound is more hydrophobic than those in FIG. 19 and therefore a more significant increase in the $C_2H_4$ production activity is visible.

The invention claimed is:

1. An electrode comprising:

a metallic nanostructure, the metal of which is selected from the group of Cu, Zn, Ni, Fe, and Ag or mixtures thereof, said metallic nanostructure being part of a metallic hierarchical structure containing both micro and nanostructuration, said metallic hierarchical structure being of the same metal as defined above, a hydrophobic layer of compounds covering the surface of said metallic hierarchical structure, said compounds being chemisorbed to said surface, said metallic hierarchical structure being porous, said compounds being chosen from the group of:

a compound of Formula 1,

R—A Formula 1 wherein,

A represents,

SH,

—P(O)(OH)2,

—CO2H,

—SeH,

—TeH,

—Si(OH)3,

Six3, wherein X represents a halogen, an acetylacetone group having the structure of Formula 2, Formula 2

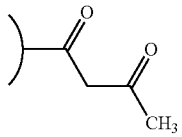

R is chosen from the groups of, (C5-C100)-alkyl linear or branched, (C5-C100)-alkenyl linear or branched, (C5-C100)-alkynyl linear or branched, (C5-C100)-heteroralkyl linear or branched, (C5-C100)-heteroalkenyl linear or branched, (C5-C100)-heteroalkynyl linear or branched, said alkyl, alkenyl, alkynyl, heteroalkyl, heteroalkenyl and heteroalkynyl can be further substituted by one or more groups selected from:

amines,

—ORa, wherein Ra represents a hydrogen atom, a (C1-C20)-alkyl group, a (C1-C10)-alkyl group, or a (C1-C5)-alkyl group, halogen, aryl, —CO2Rb, wherein Rb represents a hydrogen atom, a (C1-C20)-alkyl group, a (C1-C10)-alkyl group, or a (C1-C5)-alkyl group, —CX3 groups, wherein X represents a halogen, a compound of Formula 3, Formula 3

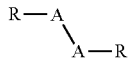

wherein,

A represents Se or S,

R is a group as defined above, polysiloxane compounds chosen from the groups of (C1-C100)-polyalkylsiloxane, or polyarylsiloxane, said polyalkylsiloxane and polyarylsiloxane can be further substituted by one or more groups selected from:

amines,

—ORa, wherein Ra represents a hydrogen atom, a (C1-C20)-alkyl group, a (C1-C10)-alkyl group, or a (C1-C5)-alkyl group, halogen, wherein X represents a halogen, —CO2Ra, wherein Ra represents a hydrogen atom, a (C1-C20)-alkyl group, a (C1-C10)-alkyl group, or a (C1-C5)-alkyl group, said electrode having a hydrophobicity as determined by contact angle measurement from 130° to 175°, said electrode having an electrochemically active surface area (EASA) lower than 10% of the geometric surface area of said metallic hierarchical structure, wherein regions of the electrochemically active surface area are located at extremities of said metallic hierarchical structure, and wherein the electrochemically active surface area is exposed to an electrolyte solution.

2. The electrode according to claim 1, wherein said metal is chosen from Cu or Zn, or mixtures of Cu and Ag or mixtures of Zn and Ag.

3. The electrode according to claim 1, wherein said compound is chosen from a compound of Formula 1, wherein A represents-SH.

4. The electrode according to claim 3, wherein said compound is 1-octadecanethiol or 1-dodecanethiol.

5. The electrode according to claim 1, wherein said metal is chosen from Cu, and wherein said compound is chosen from a compound of Formula 1, wherein A represents-SH, and wherein said metallic hierarchical structure is dendritic.

6. The electrode according to claim 1, wherein said metallic nanostructure contains dendritic hierarchical structures.

7. The electrode according to claim 1, wherein the hydrophobic layer is structurally and chemically stable during electrolysis at currents in the range of −0.1 to −50 mA $cm^{-2}$ and at potentials in the range of −1.5 V to −4 V.

8. The electrode according to claim 1, wherein gas bubbles are trapped between the surface of the metallic hierarchical structure and the electrolyte solution.

9. A method for the implementation of an electrochemical reaction, said electrochemical reaction being the reduction of CO2 or CO gas or mixture thereof into hydrocarbon(s) or alcohol(s) or mixtures thereof in aqueous medium, or the reduction of CO2 gas into CO in aqueous medium, wherein the method comprises a step of contacting said CO2 gas, or said CO gas, with an electrode comprising or consisting of:

a metallic nanostructure, the metal of which is selected from the group of Cu, Zn, Ni, Fe, and Ag or mixtures thereof, said metallic nanostructure being part of a metallic hierarchical structure containing both micro and nanostructuration, said metallic hierarchical structure being of the same metal as defined above, a hydrophobic layer of compounds covering the surface of said metallic hierarchical structure, said compounds being chemisorbed to said surface, said metallic hierarchical structure being porous, said compounds being chosen from the group of:

a compound of Formula 1,

R—A Formula 1 wherein,

A represents,

—SH,

—P(O)(OH)2,

—CO2H,

—SeH,

—TeH,

—Si(OH)3,

Six3, wherein X represents a halogen, an acetylacetone group having the structure of Formula 2, Formula 2

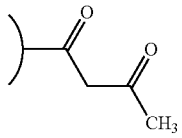

R is chosen from the groups of, (C5-C100)-alkyl linear or branched, (C5-C100)-alkenyl linear or branched, (C5-C100)-alkynyl linear or branched, (C5-C100)-heteroralkyl linear or branched, (C5-C100)-heteroalkenyl linear or branched, (C5-C100)-heteroalkynyl linear or branched, said alkyl, alkenyl, alkynyl, heteroalkyl, heteroalkenyl and heteroalkynyl can be further substituted by one or more groups selected from:

amines,

—ORa, wherein Ra represents a hydrogen atom, a (C1-C20)-alkyl group, a (C1-C10)-alkyl group, or a (C1-C5)-alkyl group, halogen, aryl, —CO2Rb, wherein Rb represents a hydrogen atom, a (C1-C20)-alkyl group, a (C1-C10)-alkyl group, or a (C1-C5)-alkyl group, —CX3 groups, wherein X represents a halogen, a compound of Formula 3, Formula 3

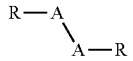

wherein,

A represents Se or S,

R is a group as defined above, polysiloxane compounds chosen from the groups of (C1-C100)-polyalkylsiloxane, or polyarylsiloxane, said polyalkylsiloxane and polyarylsiloxane can be further substituted by one or more groups selected from:

amines,

—ORa, wherein Ra represents a hydrogen atom, a (C1-C20)-alkyl group, a (C1-C10)-alkyl group, or a (C1-C5)-alkyl group, halogen, wherein X represents a halogen, —CO2Ra, wherein Ra represents a hydrogen atom, a (C1-C20)-alkyl group, a (C1-C10)-alkyl group, or a (C1-C5)-alkyl group, said electrode having a hydrophobicity as determined by contact angle measurement from 130° to 175°, said electrode having an electrochemically active surface area (EASA) lower than 10% of the geometric surface area of said metallic hierarchical structure, wherein regions of the electrochemically active surface area are located at extremities of said metallic hierarchical structure, and wherein the electrochemically active surface area is exposed to an electrolyte solution.

10. The method according to claim 9, for the reduction of $CO_2$ or CO gas or mixture thereof into ethylene in aqueous medium.

11. The method according to claim 9, for the reduction of $CO_2$ or CO gas or mixture thereof into ethanol or propanol, or mixtures thereof.

12. Method according to claim 9, wherein concomitant proton reduction to hydrogen is limited to 20% Faradaic efficiency.

13. The method according to claim 9, for the reduction of $CO_2$, CO or mixtures thereof into hydrocarbon(s) or alcohol(s) or mixtures thereof, comprising the following steps:

placing said electrode, together with an anode, in an electrolyte solution;

provision of an external source of electricity to said electrode;

provision of CO and/or CO2 gas to the electrolyte solution;

recovery of the hydrocarbon(s) or alcohol(s) or mixtures thereof formed during electrolysis.

14. The method according to claim 9, for the reduction of $CO_2$ into CO, comprising the following steps:

placing said electrode, together with an anode, in an electrolyte solution;

provision of an external source of electricity to said electrode;

provision of $CO_2$ gas to the electrolyte solution;

recovery of CO formed during electrolysis.

15. Process for the preparation of an electrode comprising or consisting of:

a metallic nanostructure, the metal of which is selected from the group of Cu, Zn, Ni, Fe, and Ag or mixtures thereof, said metallic nanostructure being part of a metallic hierarchical structure containing both micro and nanostructuration, said metallic hierarchical structure being of the same metal as defined above, a hydrophobic layer of compounds partially or totally covering the surface of said metallic hierarchical structure, said compounds being chemisorbed to said surface, said metallic hierarchical structure being porous, said compounds being chosen from the group of:

a compound of Formula 1,

R—A Formula 1 wherein,

A represents,

—SH,

—P(O)(OH)2,

—CO2H,

—SeH,

—TeH,

—Si(OH)3,

Six3, wherein X represents a halogen, an acetylacetone group having the structure of Formula 2, Formula 2

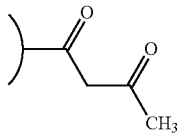

R is chosen from the groups of, (C5-C100)-alkyl linear or branched, (C5-C100)-alkenyl linear or branched, (C5-C100)-alkynyl linear or branched, (C5-C100)-heteroralkyl linear or branched, (C5-C100)-heteroalkenyl linear or branched, (C5-C100)-heteroalkynyl linear or branched, said alkyl, alkenyl, alkynyl, heteroalkyl, heteroalkenyl and heteroalkynyl can be further substituted by one or more groups selected from:

amines,

—$OR^a$, wherein Ra represents a hydrogen atom, a (C1-C20)-alkyl group, a (C1-C10)-alkyl group, or a (C1-C5)-alkyl group, halogen, aryl, —$CO_2R^b$, wherein Rb represents a hydrogen atom, a (C1-C20)-alkyl group, a (C1-C10)-alkyl group, or a (C1-C5)-alkyl group, —$CX_3$ groups, wherein X represents a halogen, a compound of Formula 3, Formula 3

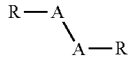

wherein,

A represents Se or S,

R is a group as defined above, polysiloxane compounds chosen from the groups of (C1-C100)-polyalkylsiloxane, or polyarylsiloxane, said polyalkylsiloxane and polyarylsiloxane can be further substituted by one or more groups selected from:

amines,

—$OR^a$, wherein $R^a$ represents a hydrogen atom, a (C1-C20)-alkyl group, a (C1-C10)-alkyl group, or a (C1-C5)-alkyl group, halogen, wherein X represents a halogen, —$CO_2R^a$, wherein Ra represents a hydrogen atom, a (C1-C20)-alkyl group, a (C1-C10)-alkyl group, or a (C1-C5)-alkyl group, said electrode having a hydrophobicity as determined by contact angle measurement from 130° to 175°, said electrode having an electrochemically active surface area (EASA) lower than 10% of the geometric surface area of said metallic hierarchical structure, wherein regions of the electrochemically active surface area are located at extremities of said metallic hierarchical structure, and wherein the electrochemically active surface area is exposed to an electrolyte solution, wherein the process comprises an initial step of preparation of an electrode having a metallic hierarchical structure containing both micro and nanostructuration, and a step of coating of the surface of said metallic hierarchical structure of said electrode with compounds to obtain a metallic hierarchical structure coated with a hydrophobic layer of compounds, or comprises an initial step of preparation of an electrode having a metallic hierarchical structure containing both micro and nanostructuration, and step of contacting the surface of said metallic hierarchical structure of said electrode with a monomer, precursor of a polymer, and a step of polymerization of said monomer, both on the surface of said metallic hierarchical structure, creating a first layer, and on said first created layer, thus forming a multilayer of polymerized compounds.

16. The process according to claim 15, further comprising, after the step of coating, a step of washing said metallic hierarchical structure coated with a hydrophobic layer of compounds, to obtain a hydrophobic monolayer (first layer) of compounds.

17. The process according to claim 15, wherein the polymerized compounds are polysiloxane compounds.

* * * * *